US011466397B2

(12) United States Patent
Mangan et al.

(10) Patent No.: US 11,466,397 B2
(45) Date of Patent: Oct. 11, 2022

(54) CLOTHES DRYER AND METHOD OF DRYING CLOTHES

(71) Applicant: MAIKOLOGY DESIGNATED ACTIVITY COMPANY, County Dublin (IE)

(72) Inventors: Patricia Mangan, County Dublin (IE); Colin Keogh, County Wicklow (IE); Sean Toomey, County Dublin (IE)

(73) Assignee: MAIKOLOGY DESIGNATED ACTIVITY COMPANY, County Dublin (IE)

( * ) Notice: Subject to any disclaimer, the term of this patent is extended or adjusted under 35 U.S.C. 154(b) by 407 days.

(21) Appl. No.: 16/087,257

(22) PCT Filed: Mar. 21, 2017

(86) PCT No.: PCT/EP2017/056737
§ 371 (c)(1),
(2) Date: Sep. 21, 2018

(87) PCT Pub. No.: WO2017/162694
PCT Pub. Date: Sep. 28, 2017

(65) Prior Publication Data

US 2019/0100866 A1 Apr. 4, 2019

(30) Foreign Application Priority Data

Mar. 21, 2016 (EP) ..... 16161410

(51) Int. Cl.
*D06F 58/10* (2006.01)
*D06F 58/26* (2006.01)
*D06F 34/26* (2020.01)

(52) U.S. Cl.
CPC ..... *D06F 58/10* (2013.01); *D06F 58/26* (2013.01); *D06F 34/26* (2020.02)

(58) Field of Classification Search
CPC ..... D06F 58/10; D06F 58/14; D06F 58/26; F26B 3/286
(Continued)

(56) References Cited

U.S. PATENT DOCUMENTS 2,704,896 A * 3/1955 Hopkins ..... D06F 58/10 34/76
4,069,593 A * 1/1978 Huang ..... F26B 3/286 126/633
(Continued)

FOREIGN PATENT DOCUMENTS

CN 204401332 6/2015
EP 0257712 B1 3/1988
(Continued)

OTHER PUBLICATIONS

CN204401332—Machine Translation (Year: 2015).*
International Search Report issued in PCT/EP2017/056737, dated Sep. 28, 2017 (4 pages).

*Primary Examiner* — Marc Lorenzi
(74) *Attorney, Agent, or Firm* — Arc IP Law, PC; Joseph J. Mayo

(57) ABSTRACT

The present invention relates to a clothes dryer and method of drying clothes. A clothes dryer (10) comprising:—a drying chamber (31), arranged to accommodate clothes, defined by at least one wall,—an air pathway, along which air is arranged to flow from an air inlet to an air outlet, comprising the drying chamber (31), wherein,—the at least one wall comprises a cavity wall comprising a first curved surface (11), a cavity (16) and a second curved surface (15),—the first curved surface (11) of the cavity wall being arranged to define an exterior surface of the dryer and to facilitate a transmission of light energy to the cavity (16) and/or the second curved surface (15),—the cavity (16) being arranged as comprised in the air pathway, and,—the
(Continued)

Figure 1A:
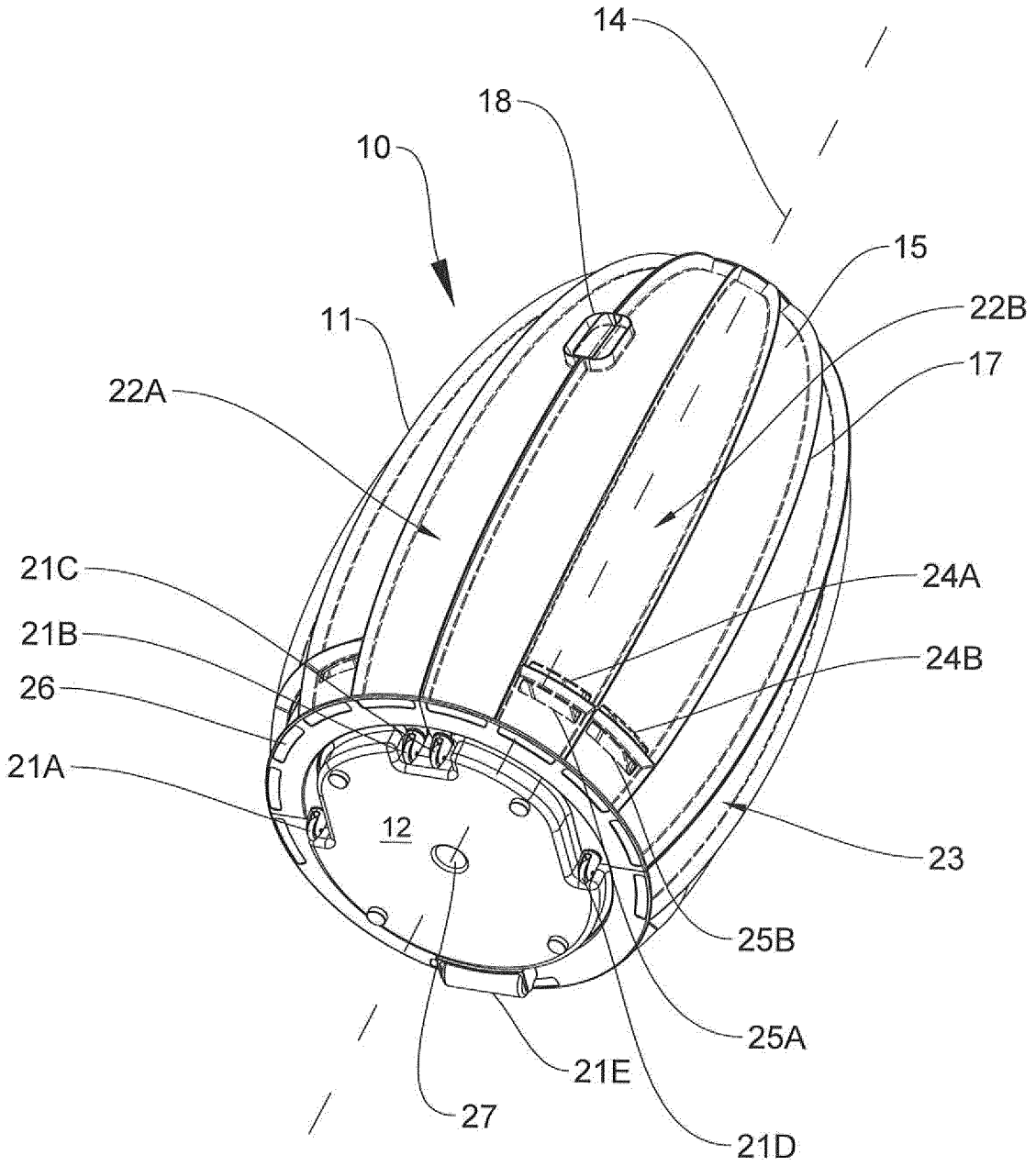
Figure 1B:
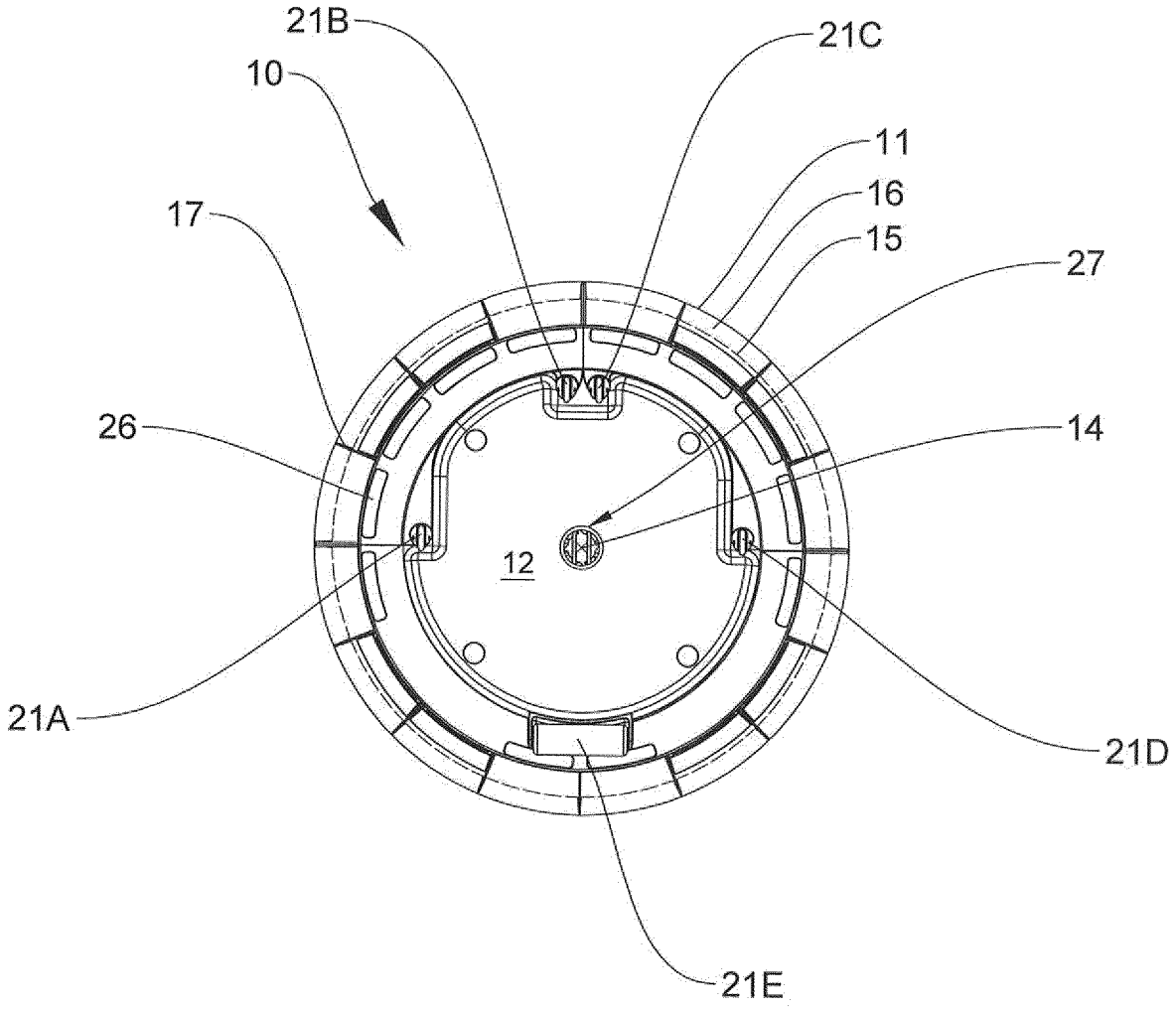

second curved surface (15) of the cavity wall being arranged to define at least a part of the drying chamber (31).

25 Claims, 17 Drawing Sheets

(58) Field of Classification Search
USPC ..... 34/93, 522
See application file for complete search history.

(56) References Cited

U.S. PATENT DOCUMENTS 5,369,892 A * 12/1994 Dhaemers ..... D06F 58/10 34/224
5,960,560 A * 10/1999 Stoll ..... F26B 9/066 34/529
7,900,371 B1 * 3/2011 Bullard ..... A47K 10/48 34/202
8,096,062 B1 * 1/2012 Bellen ..... D06F 58/10 34/90
2010/0132209 A1 * 6/2010 Park ..... D06F 58/203 34/201
2010/0162588 A1 * 7/2010 Newman ..... D06F 58/14 34/235
2015/0176191 A1 * 6/2015 Hong ..... D06F 39/12 34/132
2018/0231308 A1 * 8/2018 Ileleji ..... F26B 3/28

FOREIGN PATENT DOCUMENTS

FR 2727695 A1 6/1996
GB 2488443 A 4/2012
JP 2000120162 A 4/2000
KR 20030023050 A 3/2003
WO 2005084138 A3 9/2005

* cited by examiner

CLOTHES DRYER AND METHOD OF DRYING CLOTHES

FIELD

The present invention relates to a clothes dryer, in particular to a clothes dryer arranged to utilise solar energy and/or power. Moreover, the present invention concerns method of drying clothes.

BACKGROUND

Many methods exist to facilitate the drying of clothes or other material or textile items associated with a household e.g. towels, sheets etc. Usual drying methods include hanging items on a line, or arranging them on a drying frame, located outdoors to allow fresh air and sunlight to accelerate the drying effect in a traditional fashion. Various designs of apparatus exist to perform this function. Indoor drying racks or lines have been designed, in a variety of forms, to make use of the heat of the house where heat rises, e.g. near the ceiling in a stairwell, or by means of hanging garment drying bags which locally intensify the heat surrounding a garment. A range of electronic equipment also exists for drying purposes, comprising items such as tumble dryers.

The various drying methods and devices currently available suffer from a range of problems. Outdoor drying is heavily reliant on weather conditions, for example. In changeable weather conditions, especially, there is a risk that items to be dried are rendered wet again by e.g. heavy rain. Outdoor clothes drying can also be subject to theft, high pollution and pollen levels. Indoor drying can be inconvenient and slow. Further, a release of moisture into the atmosphere of the room in which the items are dried may be undesirable and/or damaging. Increased indoor humidity levels from clothes drying have been linked to negative respiratory and skin conditions. And an increased trend of airtight houses increasing this problem. The use of electrical equipment requires the use of power, dryers being heavy consumers of electrical power despite the availability of more energy-efficient modern appliances. Such power usage is detrimental to the environment and is expensive and costly for the user.

PCT Patent Publication number WO2005/084138, assigned to Aytec Avnim Limited, discloses an apparatus for drying of laundry by use of solar energy, comprising: (i) at least one inner compartment with at least one side containing a solar energy absorbing material on the exterior surface, at least one air inlet at the upper side and at least one air outlet at the lower part, and means for hanging the laundry; (ii) one outer compartment that has at least one transparent side and encloses said inner compartment, thus forming a space between them used as an airway; and (iii) at least one air inlet on the lower part of at least one side and/or at the bottom side of the outer compartment for conveying air from the outside surroundings into the space between the outer and inner compartments, and at least one air outlet on at least one side of the outer compartment. The apparatus discloses a rectangular flat surface device resulting in poor or inconsistent solar collection and poor clothes drying results. For example, in operation the flat surface has a single angle of incidence for a given time it will have an optimal angle at an optimal time, and will drop in efficiency before and after this time. This design will create a peak in thermal gain, but will keep reducing efficiency either side of this time thus reducing the amount of drying time. The flat surface design also requires calibration to ensure it is perpendicular to the incident of light at peak daylight hours. Moreover the device is not a consistent or efficient or reliable machine with reduced operational hours due to its rigid rectangular shape.

European Patent Publication number EP 0257712 discloses a drying device for drying laundry, clothing and the like, comprising a space enclosed by the bottom, walls and top surface of the device, in which space, if desired, racks or the like means for the articles to be dried are or can be arranged, whereas in one of the walls of the device there is received a solar collector arranged in such a manner that solar radiation impinging upon the collector is emitted substantially in the form of heat directly and/or indirectly in the said space (the drying space), the device being further provided with means for enabling an air flow through the space. Again a problem with this apparatus is that is suffers from poor solar collection and poor clothes drying results.

It is therefore an object to provide an improved solar clothes dryer to overcome the above mentioned problems.

SUMMARY

The present invention seeks to provide an improved clothes dryer. Moreover, the present invention seeks to provide a clothes dryer comprising an improved environmental protection by means of reduced environmental impact.

According to a first aspect of the present invention, there is provided a clothes dryer, as set out in the appended claims, comprising:

- a drying chamber, arranged to accommodate clothes, defined by at least one wall,
- an air pathway, along which air is arranged to flow from an air inlet to an air outlet, comprising the drying chamber,
- wherein,
- the at least one wall comprises a cavity wall comprising a first curved surface, a cavity and a second curved surface,
- the first curved surface of the cavity wall being arranged to define an exterior surface of the dryer and to facilitate a transmission of light energy to the cavity and/or the second curved surface,
- the cavity being arranged as comprised in the air pathway, and,
- the second curved surface of the cavity wall being arranged to define at least a part of the drying chamber.

The invention is of advantage in that it provides a device, which dries clothes, or other materials generally comprised in a household, in an efficient, cost-effective, environmentally manner.

Advantageously, the air pathway formed by the cavity is essentially arranged such that the air comprised in the cavity forms a layer of air, at least partially surrounding the drying chamber, thereby providing additional temperature insulation around the drying chamber. This assists with retaining the warmth of the drying chamber and reduces the requirement for or power expended by any optional additional heating provided therein. The invention utilizes curved walls to provide an improved solar drying clothes machine.

The curved form of the unit generally, and specifically the curved form of the first surface the curved form of the cavity and the curved form of the second surface, enables consistent, and regulated solar energy collection under all time, location and environmental variations in daily and yearly solar output. The incident of light on a surface determines the amount of solar energy available for collection, this is due to light deflection and the projection effect. The present invention achieves consistent and regulated solar collection by creating a consistent 'range' of incident light being collected as the sun move in the sky. As the sun moves through the sky, the egg shaped or elliptical unit maintains a range of incident light from perpendicular to tangential at all times. The present invention maintains a range of incident light from perpendicular to tangential at all times meaning that the shape prevents over heating due to intense solar gain, and reduces efficiency flux through the day. By reducing efficiency flux the unit can operate for longer hours, making it a more functional drying machine. As the clothes dryer under all time, location and environmental variations maintains a constant range of incident light, it removes the need for calibration of the position of the unit. The removal of calibration also removes the possibility of installation error. The curved dome like shape ensures that rain and other matter falls off the clothes dryer device by gravity, thereby improving performance when the device is placed in an outdoor area.

The elliptical chamber or cavity improves the airflow by reducing stagnation, and minimizing resistance to airflow. Corners do not circulate air evenly, which causes airflow turbulence and results in stagnation. By removing corners the disclosed invention reduces stagnation spots and reduces resistance to flow due to turbulence. This improved airflow and reduced stagnation encourages evaporation (by way of agitation) from the clothes and improves the efficiency of removing humid air. The elliptical chamber harnesses the Venturi effect by way of the curved wall of the inner chamber and outlet vent. As air moves upwards from the base of the inner chamber towards the outlet, the chamber walls curve-in creating a restriction and increasing velocity. The increased velocity causes more agitation in the clothes, which encourages evaporation, and hence improved drying.

Optionally, the clothes dryer comprises that the second surface is arranged as, at least partly, opaque AND/OR capable of absorption of light energy.

Advantageously, this feature of the present invention makes the absorption of light energy more efficient, thereby enhancing the heating of the air needed to dry the clothes or other articles present in the dryer.

Optionally, the (clothes dryer) device further comprises at least one rib arranged in co-operation with the first and second surfaces to further define at least one cavity, a length of the at least one rib being arranged comprised in a plane substantially parallel to a longitudinal axis of the clothes dryer.

Advantageously, the rib assists in the definition of channels along which the air is encouraged to flow in a controlled manner. A plurality of ribs encourages the air to be directed upwards in a short pathway, thereby making the device operation more efficient.

Optionally, at least one rib comprises at least one hole or aperture located proximate to the cavity.

Advantageously, by allowing a proportion of air to swop between channels created by the rib structure, a mixture of warmer and cooler air can be achieved. Different channels as defined by the ribs are subject to different amounts of light energy depending on location and angle of incidence of light energy. A plurality of apertures or holes can be provided according to the amount of mixing desired. The invention harnesses at least one rib arranged in cooperation with the first and second surfaces to further define at least one channel, to create an efficient air path and controlled thermal mix.

Optionally, the light energy is solar energy or energy from at least one daylight cell.

Optionally, the first surface and/or second surface of the cavity wall comprise a wall shape in the form of one of: an ellipsoidal shape, an elliptic shape, an elliptical shape, an oblong, an ooid, an ovaloid, an ovate, an oviform, an ovoid, an egg shape, an acorn shape.

Advantageously, the shape of the wall assists with achieving an optimum incidence of light energy on the device, assists the stability of the device in various difficult weather conditions and helps prevent debris and dirt from accumulating on the (light incident) exterior surface.

Optionally, the wall shape is arranged as optimised for a preferred angle of incidence of light energy.

Advantageously, this helps to maximize the energy available for the drying process.

Optionally, the cavity is tapered or shaped or dimensioned according to a shape of the first surface and/or second surface, to control air flow within the cavity.

Advantageously, such shaping assists in the optimization of the speed, flow, pressure and acceleration of the air.

Optionally, a first material of the first surface is arranged to comprise a low absorptivity transparent polymer material, preferably arranged to exhibit low emissivity and low reflectivity, AND/OR one of: polymethlamethacrylate, cellulose acetate butyrate, polycarbonate or PETG, AND/OR is arranged as UV resistant, AND/OR is waterproof, AND/OR is arranged to comprise a pattern or nano pattern.

Optionally, a second material of the second surface is arranged to comprise a non-transparent high absorptivity polymer material, AND/OR one of: polypropylene, polyethylene or polyvinyl chloride, AND/OR said second material is arranged to exhibit high emissivity and low reflectivity, AND/OR is implemented in the colour black AND/OR is arranged to comprise a pattern or nano pattern, AND/OR is arranged to maintain the drying chamber in partial shade, shade or darkness. Optionally the material comprises aluminium.

Advantageously, careful choice of material and patterning assists in the optimisation of light energy interaction with the clothes dryer for efficiency.

Optionally, the clothes dryer further comprises at least one exterior air inlet structure AND/OR at least one lower vent AND/OR at least one upper vent.

Optionally, said at least one exterior air inlet structure and/or at least one lower vent and/or at least one upper vent, are arranged as located in co-operation with at least one rib.

Optionally, the clothes dryer further comprises a fan.

Advantageously, these features assist the movement and mixing and flow of air within the device for optimization of the drying process.

Optionally, the base is arranged to be rotatable, preferably continuously, peridically, manually or in a pre-determined way.

Optionally, the base further comprises at least one water outlet structure AND/OR a weight AND/OR a ballast structure, optionally comprising a heat sink.

Advantageously, the weight or a ballast structure comprising weight, assist stability of the device. Optionally, the ballast structure may additionally be implemented as a heat sink, arranged to provide a slow release of heat to maintain the temperature of the drying chamber and/or the air circulating or channeled into the drying chamber.

Optionally, the clothes dryer uses a material with a high solar gain and a high R-value to reduce heat loss.

Optionally, a locking mechanism is provided.

Optionally, the clothes dryer comprises a rechargeable battery.

Optionally, the clothes dryer comprises a filter, for example a HEPA filter, configured to prevent pollen entering the dryer in a closed position.

Optionally, the clothes dryer comprises one or more sensors configured to regulate temperature and/or humidity and/or drying cycles.

Optionally, the clothes dryer comprises an internal UV light source configured to eliminate bacterial growth or other growth.

Optionally the ballast structure is configured as a heat sink, arranged to provide a slow release of heat to maintain a drying temperature of the drying chamber and the air circulating or channeled into the drying chamber.

Optionally the cavity is configured to cooperate with an air pathway channel.

Optionally the air pathway channel is positioned substantially through the center of the drying chamber.

Optionally the air pathway channel is positioned proximal to a sidewall of the drying chamber.

Optionally a funnel directs the heated air from the cavity into the air pathway channel and the funnel comprises a curved surface to minimise turbulence due to an air direction change.

Optionally a fan is configured to urge heated air towards the base of the drying chamber via the air pathway channel.

Optionally the fan is positioned near the top of the drying chamber to 'push' the heated air towards the base of the drying chamber.

Optionally the fan is positioned near the bottom of the drying chamber to 'pull' the heated air towards the base of the drying chamber. It will be appreciated that the device can comprise of a plurality of fans. For example an exhaust fan can be provided and one or more fans to agitate the hot air in the drying chamber.

Optionally a distribution plate and perforated plate positioned near the base and coupled with one end of the air pathway channel.

Optionally the perforated plate comprises a plurality of openings, wherein said openings are dimensioned for even distribution of hot air from the base of the drying chamber.

Optionally a hanging mechanism is mounted that allows both lateral and vertical movement of a drying rack.

According to a second aspect of the invention, there is provided a method of drying clothes as claimed in appended claim 29: there is provided a method of comprising the steps of:

- defining a drying chamber, arranged to accommodate clothes, by means of at least one wall,
- defining air pathway, along which air is arranged to flow from an air inlet to an air outlet, comprising the drying chamber,
- arranging the at least one wall to comprise a cavity wall comprising a first surface, a cavity and a second surface,
- arranging the first surface of the cavity wall to define an exterior surface of the dryer and to facilitate a transmission of light energy to the cavity and/or the second surface,
- arranging the cavity to be comprised in the air pathway, and,
- arranging the second surface of the cavity wall to define at least a part of the drying chamber.

Advantageously, the method, utilising the clothes dryer device, dries clothes, or other materials generally comprised in a household, in an efficient, cost-effective, environmentally manner.

Optionally the method further comprises the step of:

- arranging the second surface as, at least partly, opaque AND/OR capable of absorption of light energy.

Advantageously, this feature of the present invention makes the absorption of light energy more efficient, thereby enhancing the heating of the air needed to dry the clothes or other articles present in the dryer.

Optionally the method further comprises the step of:

- providing at least one rib arranged in co-operation with the first and second surfaces to further define at least one cavity, a length of the at least one rib being arranged comprised in a plane substantially parallel to a longitudinal axis of the clothes dryer.

Advantageously, the rib assists in the definition of channels along which the air is encouraged to flow in a controlled manner. A plurality of ribs encourages the air to be directed upwards in a short pathway, thereby making the device operation more efficient.

Optionally the method further comprises the step of:

- arranging the at least one rib to comprise at least one hole located proximate to the cavity.

Advantageously, by allowing a proportion of air to swop between channels created by the rib structure, a mixture of warmer and cooler air can be achieved. Different channels as defined by the ribs are subject to different amounts of light energy depending on location and angle of incidence of light energy. A plurality of holes can be provided according to the amount of mixing desired.

Optionally the method further comprises the step of:

- arranging the light energy as solar energy or energy from at least one solar cell or daylight cell.

Optionally the method further comprises the step of:

- arranging the first surface and/or second surface of the cavity wall to comprise a wall shape in the form of one of: an ellipsoidal shape, an elliptic shape, an elliptical shape, an oblong, an ooid, an ovaloid, an ovate, an oviform, an ovoid, an egg shape, an acorn shape.

Advantageously, the shape of the wall assists with achieving an optimum incidence of light energy on the device, assists the stability of the device in various difficult weather conditions and helps prevent debris and dirt from accumulating on the (light incident) exterior surface.

Optionally the method further comprises the step of:

- arranging the wall shape as optimised for a preferred angle of incidence of light energy.

Advantageously, this helps to maximize the energy available for the drying process.

Optionally the method further comprises the step of:

- arranging the cavity as tapered or shaped or dimensioned according to a shape of the first surface and/or second surface, to control air flow within the cavity.

Advantageously, such shaping assists in the optimization of the speed, flow, pressure and acceleration of the air.

Optionally the method further comprises the step of:

- arranging a first material of the first surface to comprise a low absorptivity transparent polymer material, preferably arranged to exhibit low emissivity and low reflectivity, AND/OR one of: polymethlamethacrylate, cellulose acetate butyrate, polycarbonate or PETG, AND/OR is arranged as UV resistant, AND/OR is waterproof, AND/OR is arranged to comprise a pattern or nano pattern.

Optionally the method further comprises the step of:

- arranging a second material of the second surface to comprise a non-transparent high absorptivity polymer material, AND/OR one of: polypropylene, polyethylene or polyvinyl chloride, AND/OR said second material is arranged to exhibit high emissivity and low reflectivity, AND/OR is implemented in the colour black AND/OR is arranged to comprise a pattern or nano pattern, AND/OR is arranged to maintain the drying chamber in partial shade, shade or darkness.

Advantageously, careful choice of material and patterning assists in the optimisation of light energy interaction with the clothes dryer for efficiency.

Optionally the method further comprises the step of:

providing at least one exterior air inlet structure AND/OR at least one lower vent AND/OR at least one upper vent.

Optionally the method further comprises the step of:

arranging at least one exterior air inlet structure and/or at least one lower vent and/or at least one upper vent, as located in co-operation with at least one rib.

Optionally the method further comprises the step of:

arranging the clothes dryer to further comprise a fan.

Advantageously, these features assist the movement and mixing and flow of air within the device for optimization of the drying process.

Optionally the method further comprises the step of:

arranging the base to be rotatable, preferably continuously, peridically, manually or in a pre-determined way.

Optionally the method further comprises the step of:

arranging the base to further comprise at least one water outlet structure; AND/OR, arranging the base to further comprise a weight; AND/OR, arranging the base to further comprise a ballast structure, optionally comprising a heat sink.

Advantageously, the weight or a ballast structure comprising weight, assist stability of the device. Optionally, the ballast structure may additionally be implemented as a heat sink, arranged to provide a slow release of heat to maintain the temperature of the drying chamber and/or the air circulating or channeled into the drying chamber.

It will be appreciated that features of the invention are susceptible to being combined in any combination without departing from the scope of the invention as defined by the appended claims.

DESCRIPTION OF THE DIAGRAMS

Figure 1C:
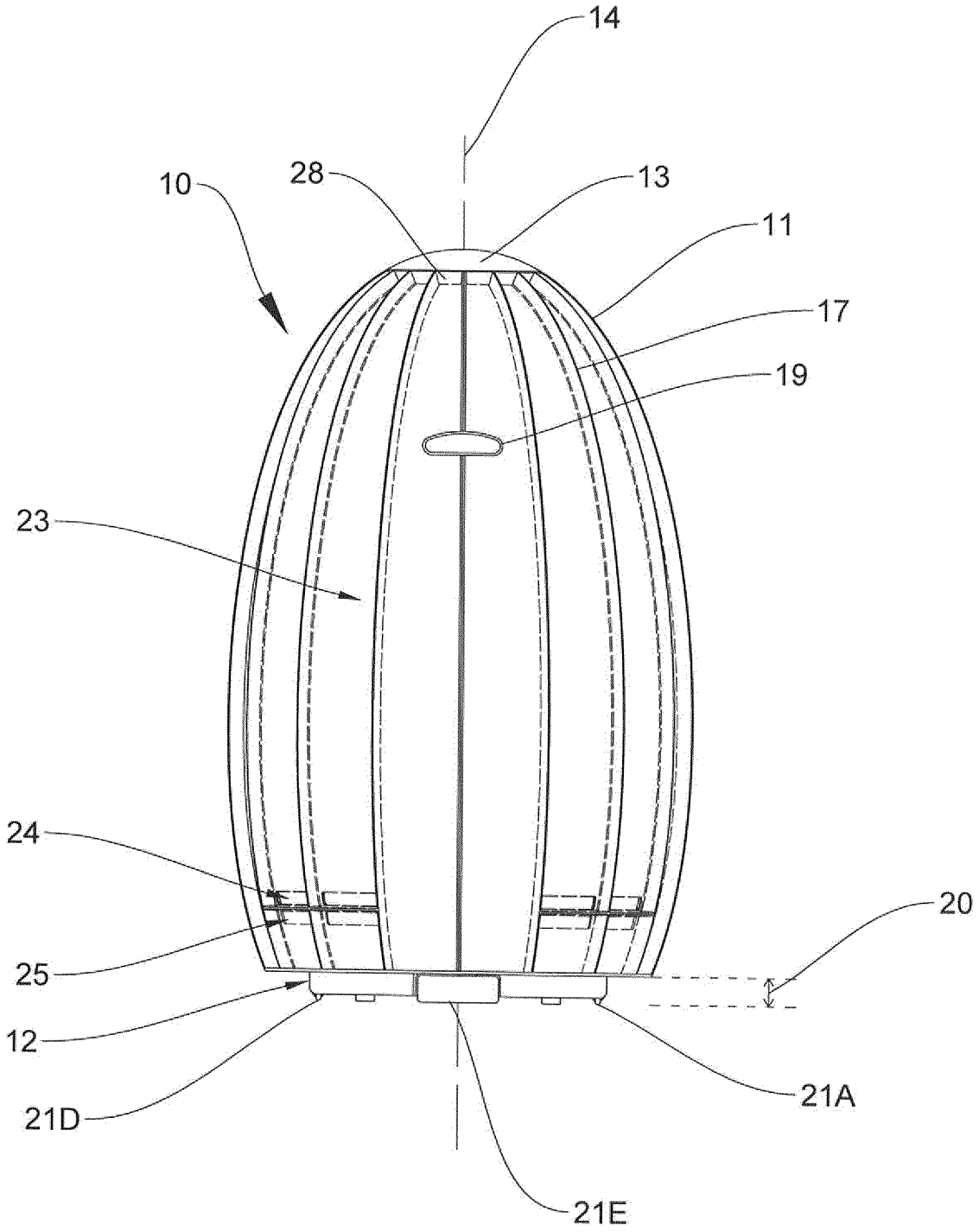
Figure 1D:
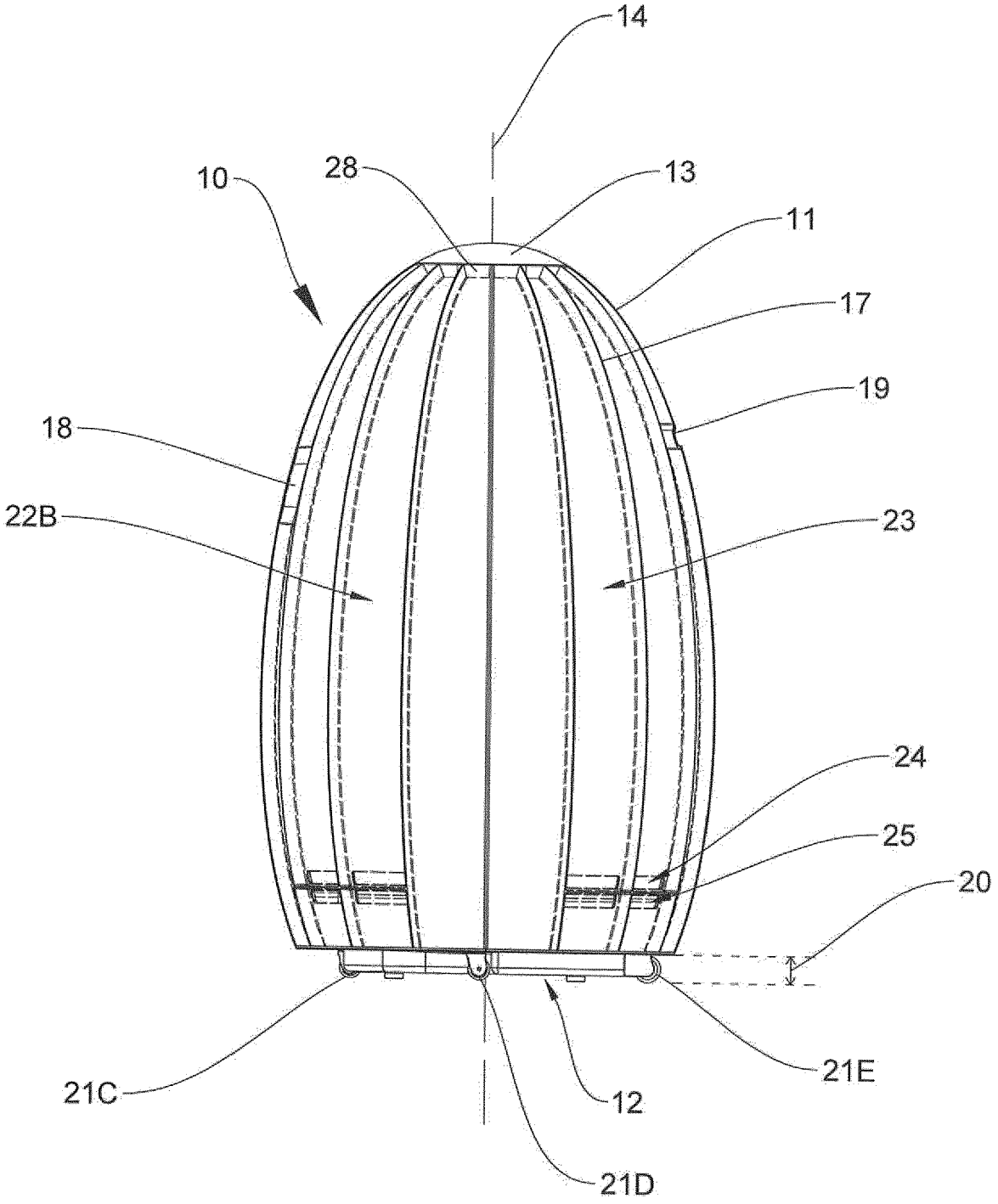
Figure 1E:
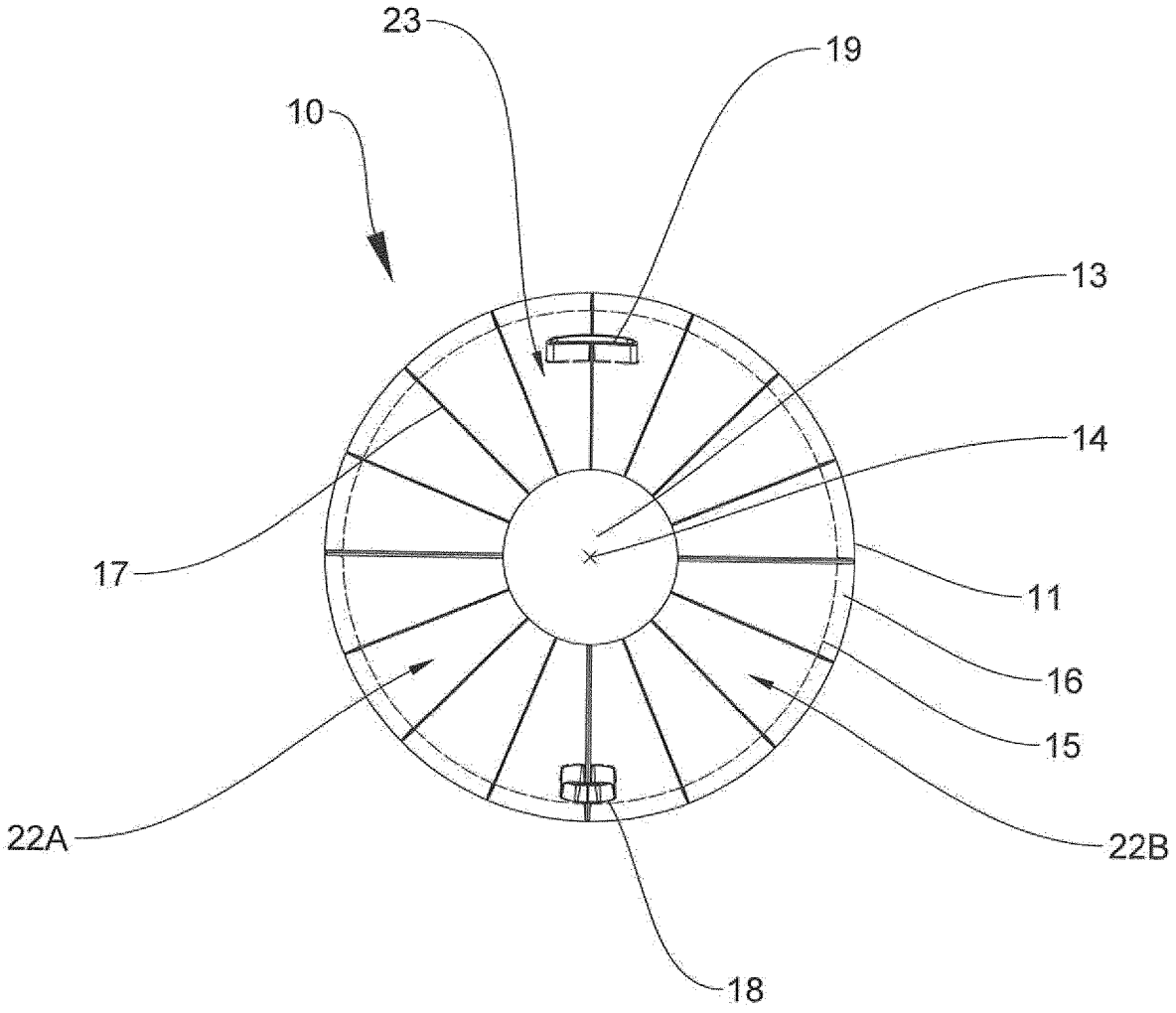
Figure 1F:
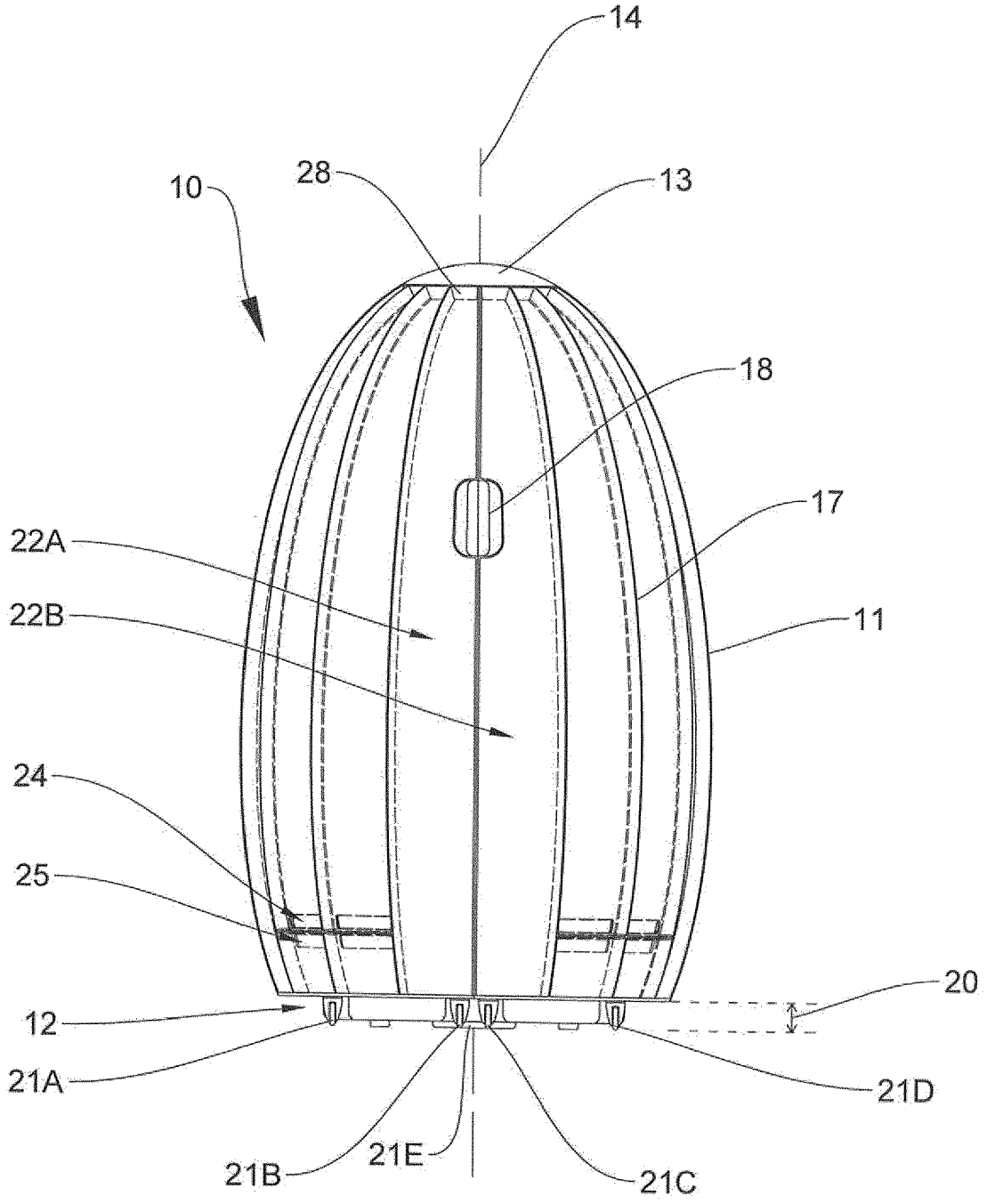
Figure 1G:
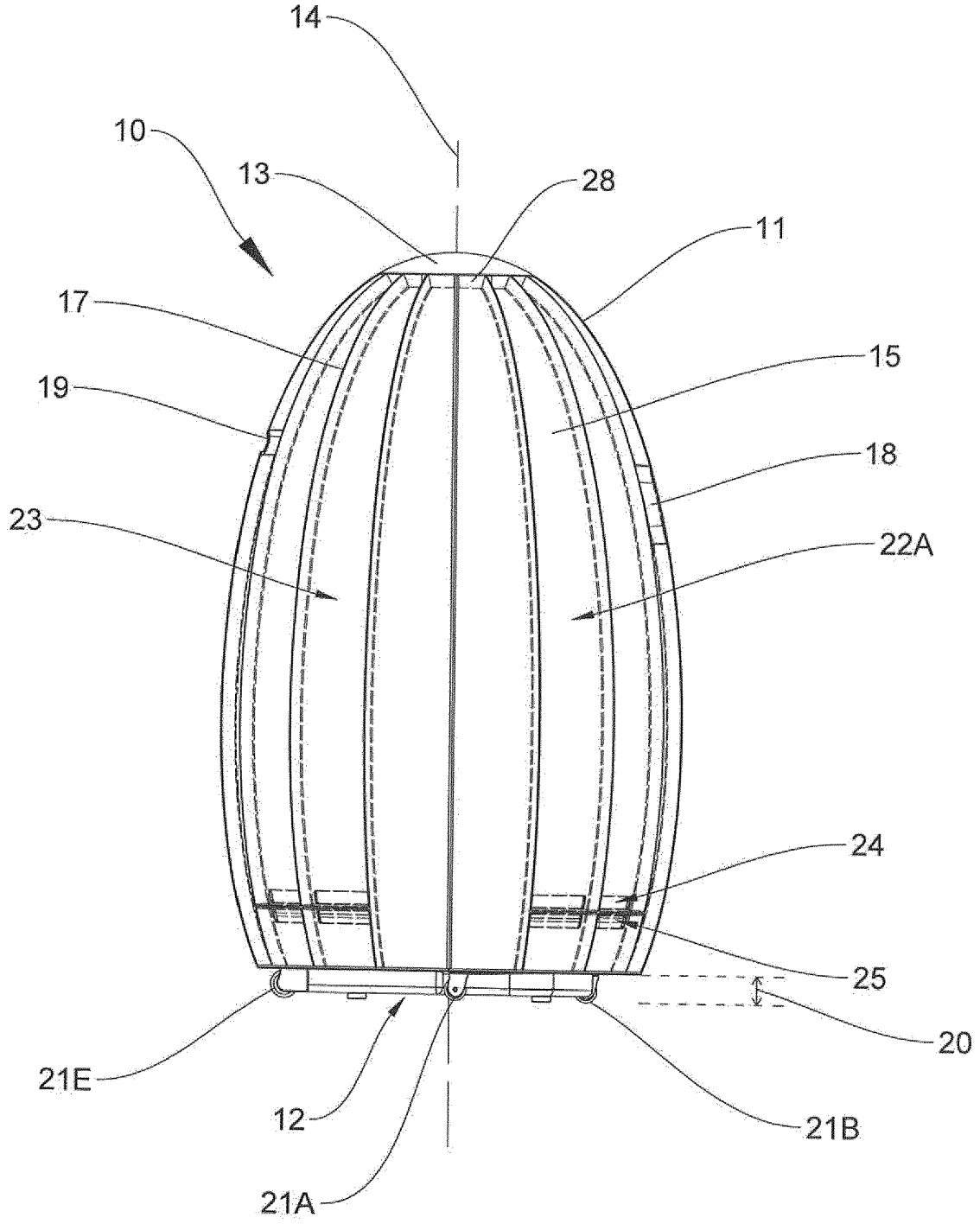
Figure 2:
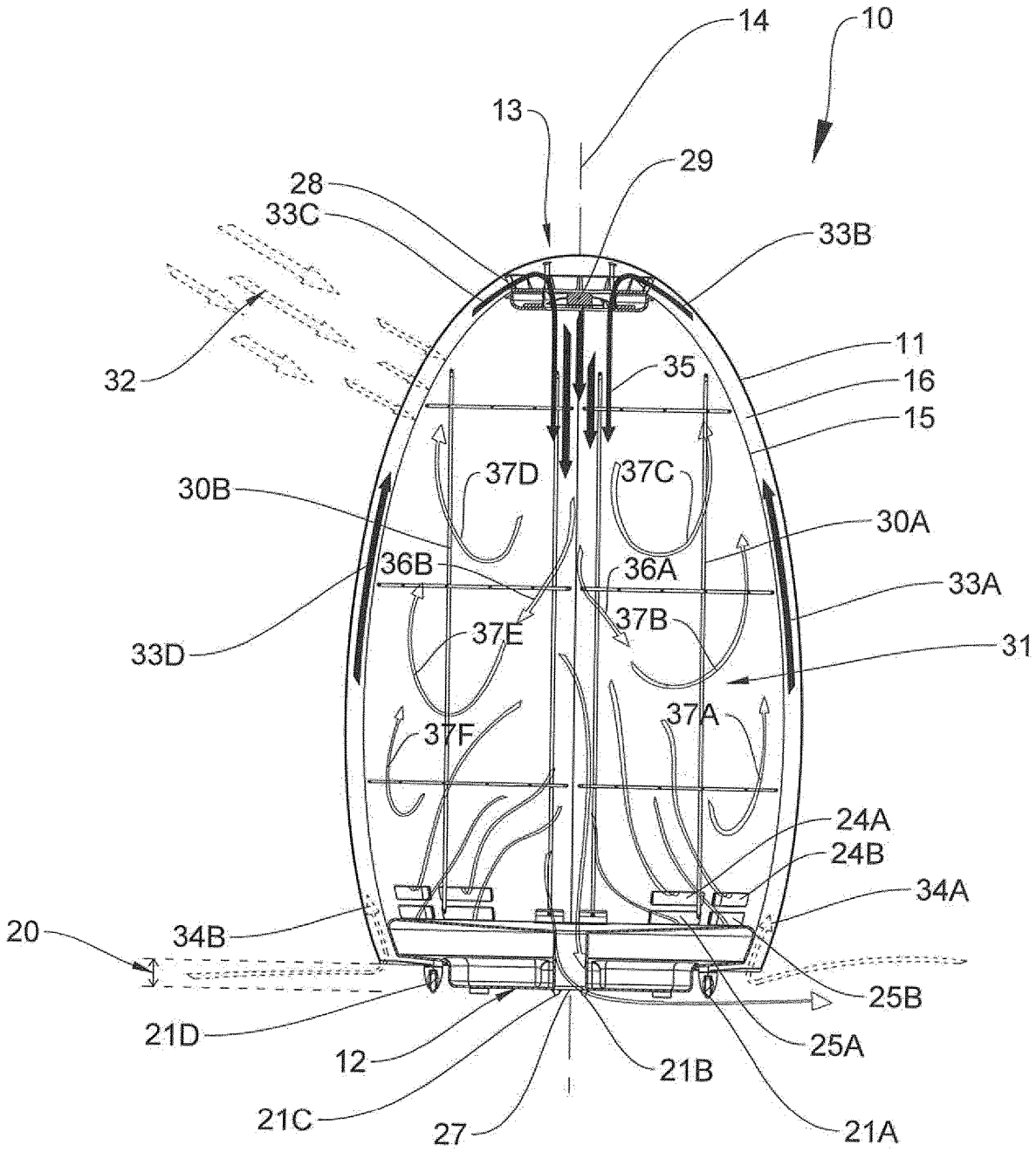
Figure 3A:
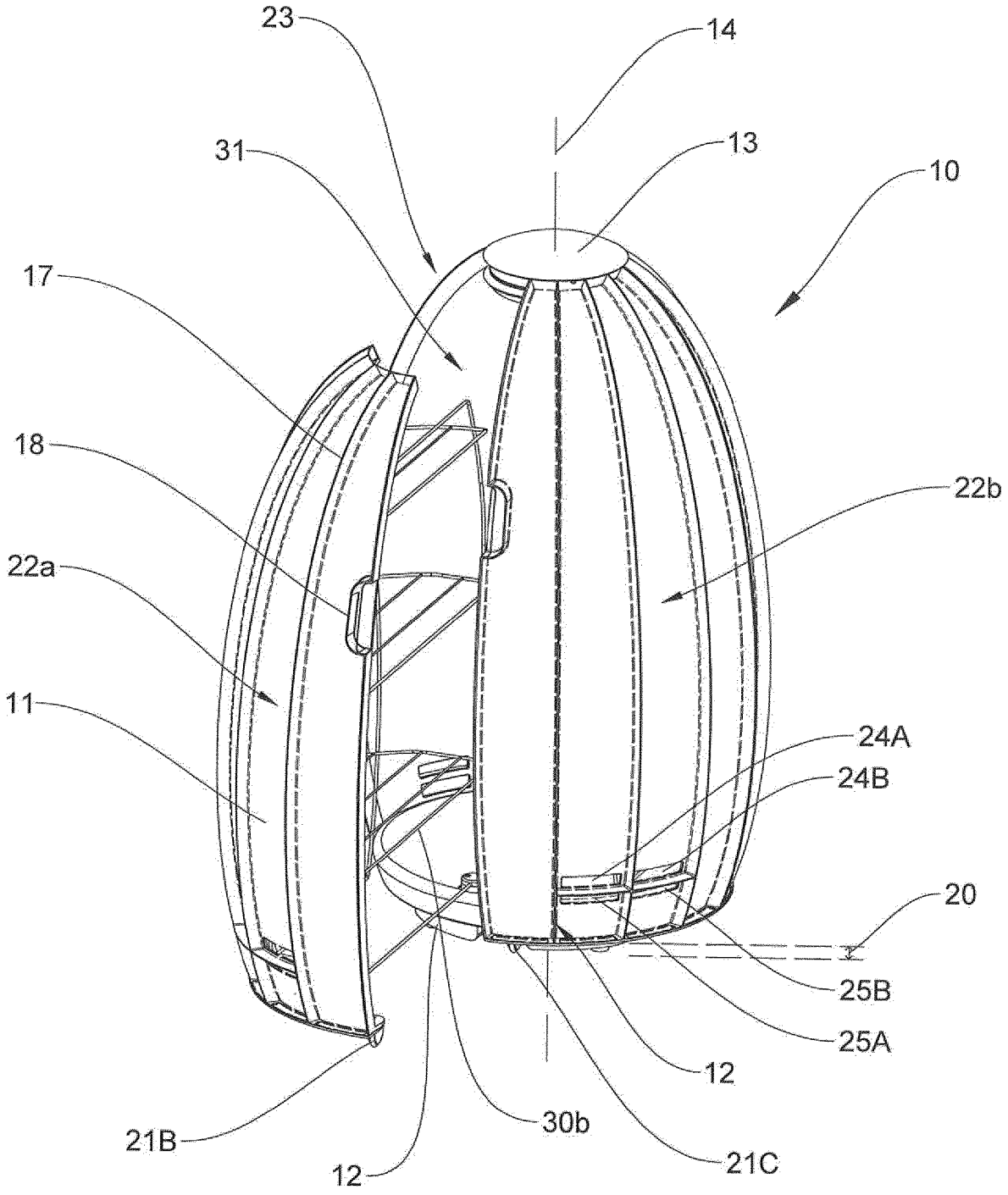
Figure 3B:
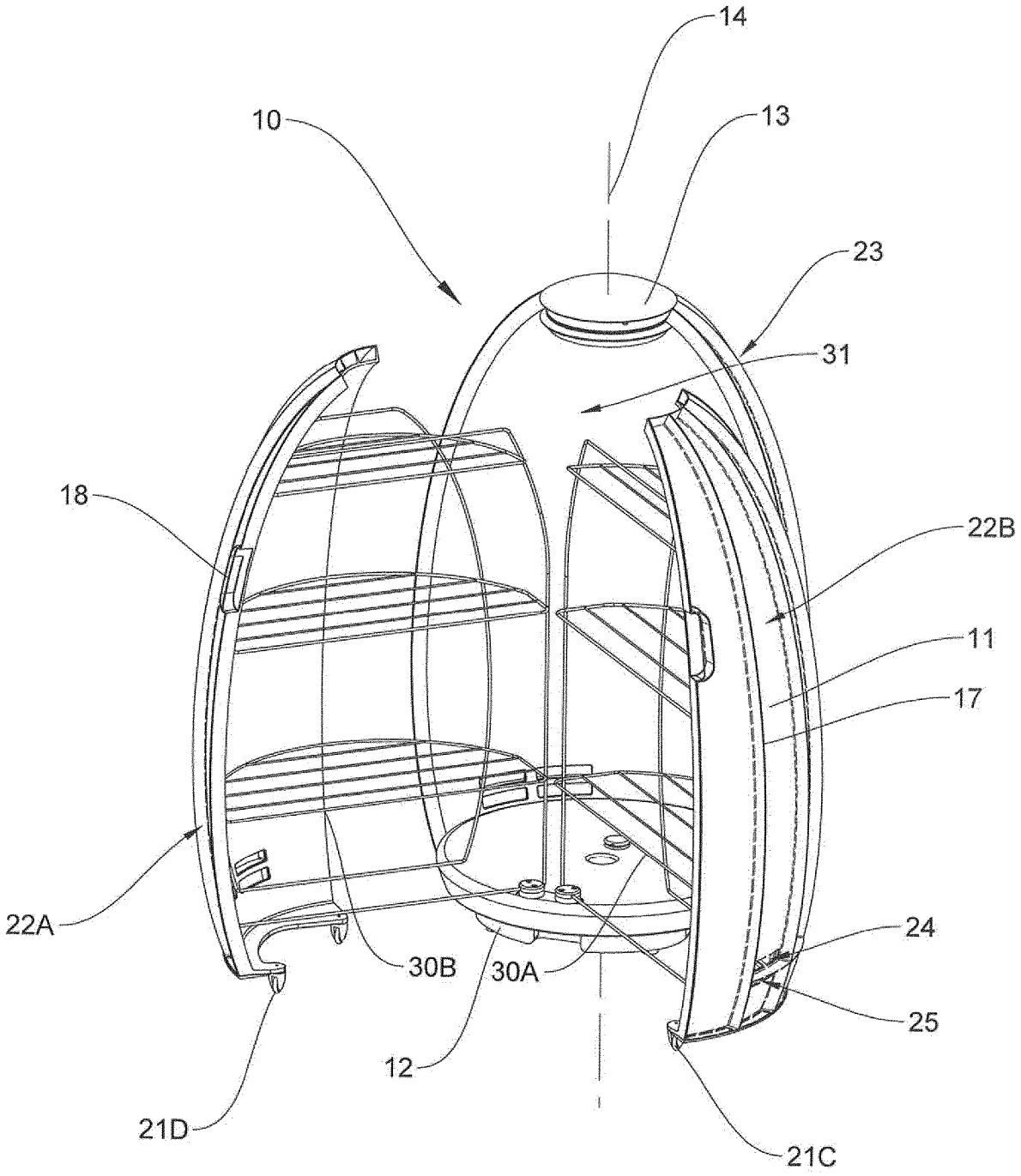
Figure 4A:
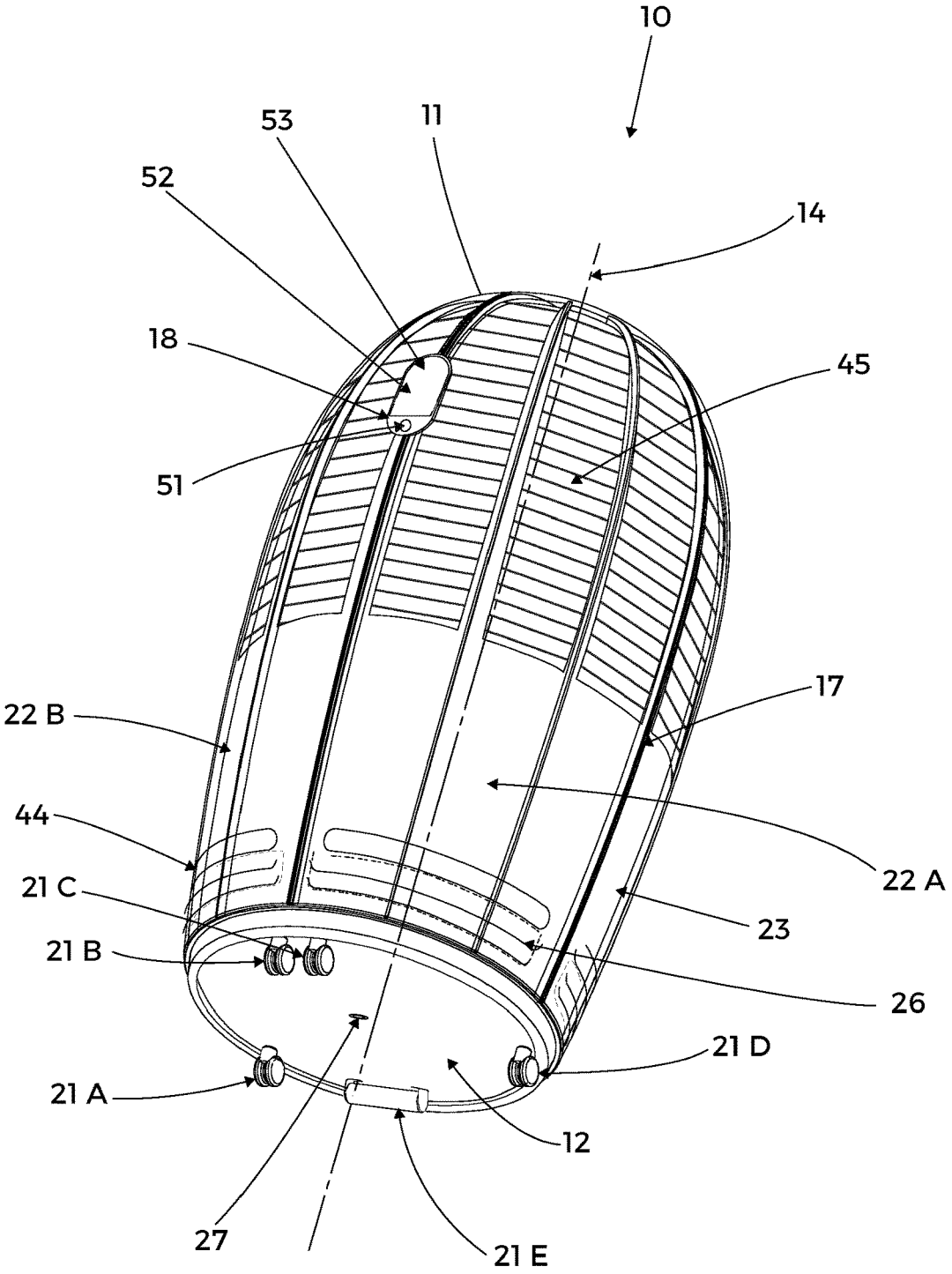
Figure 4B:
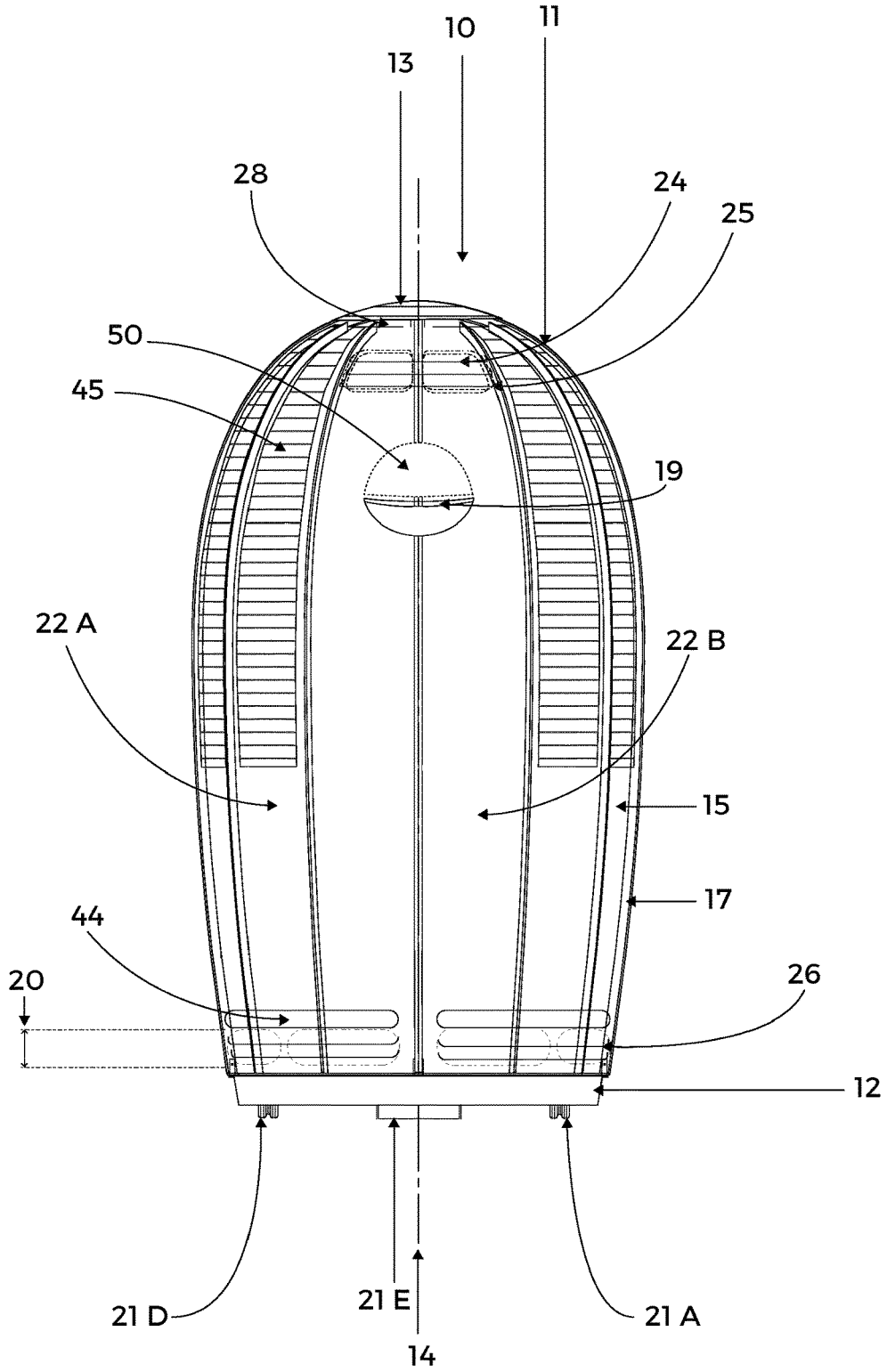
Figure 4C:
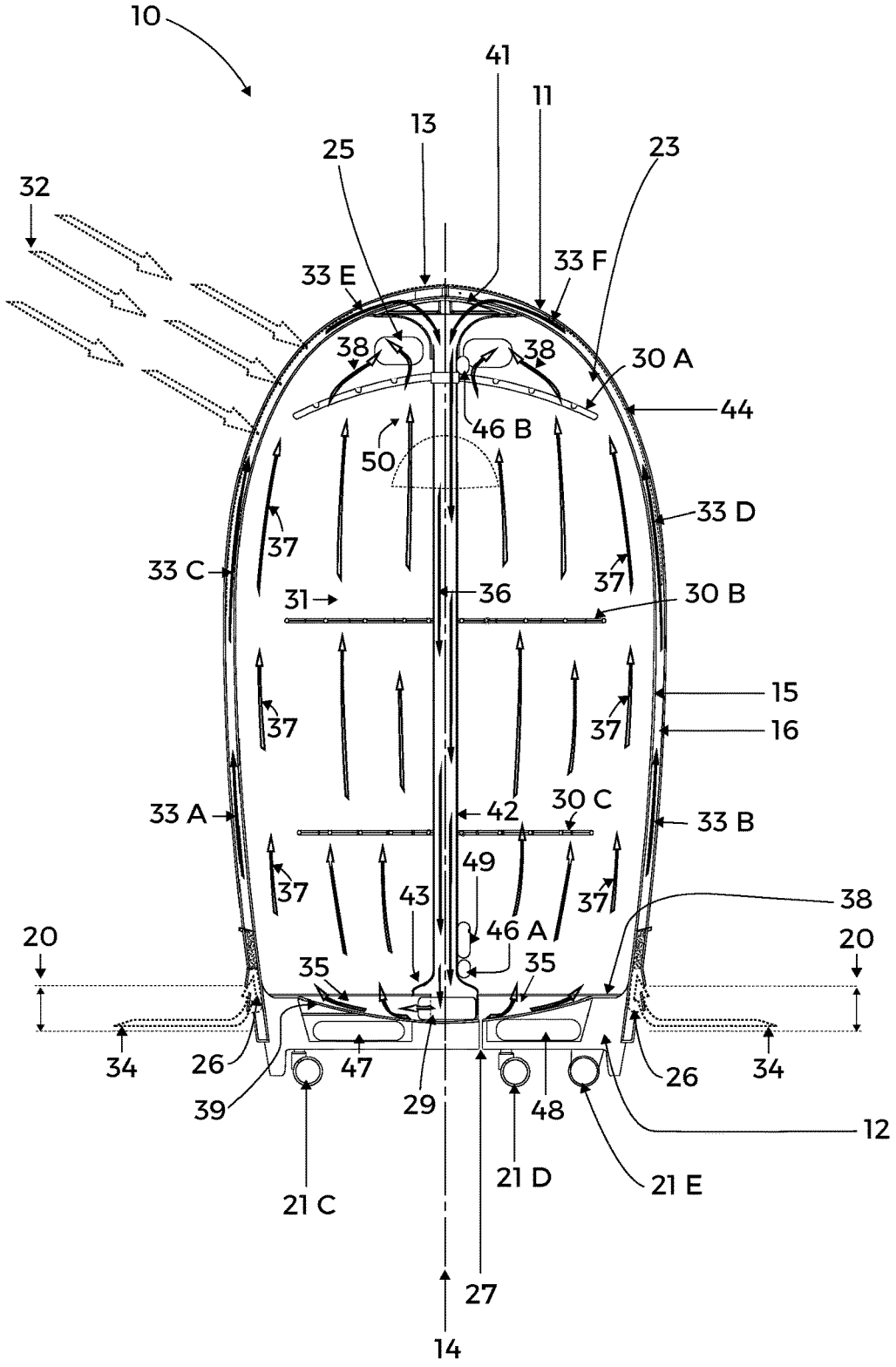
Figure 4D:
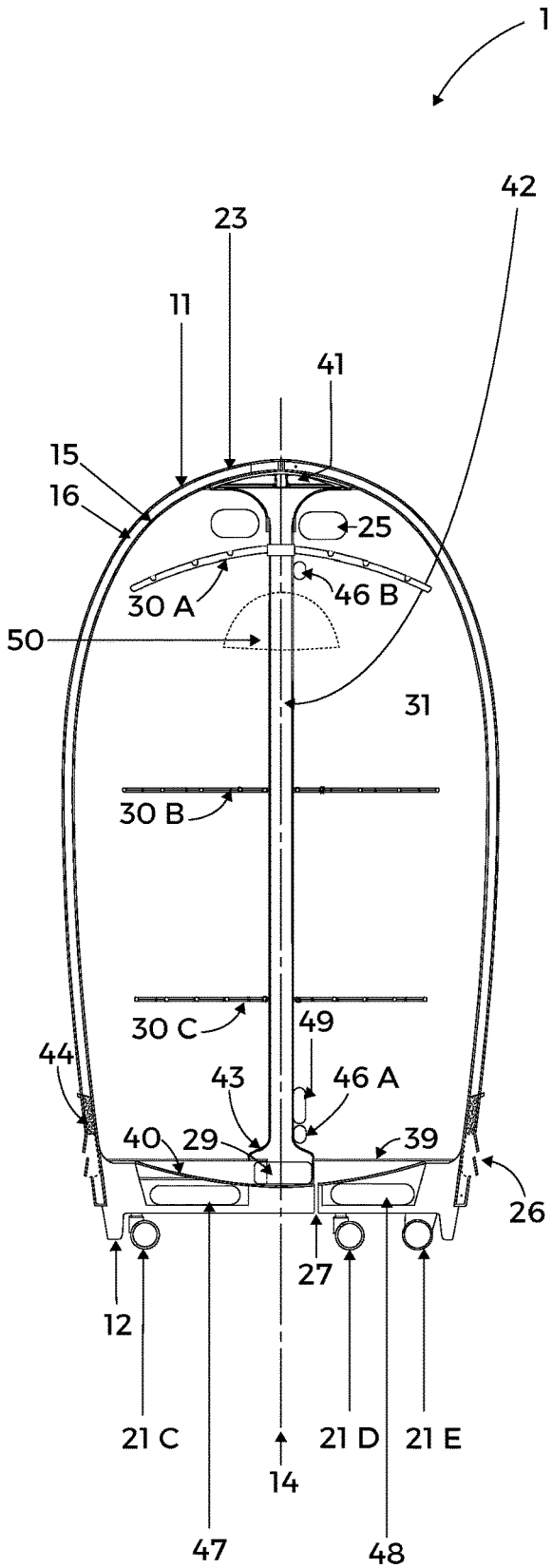
Figure 4E:
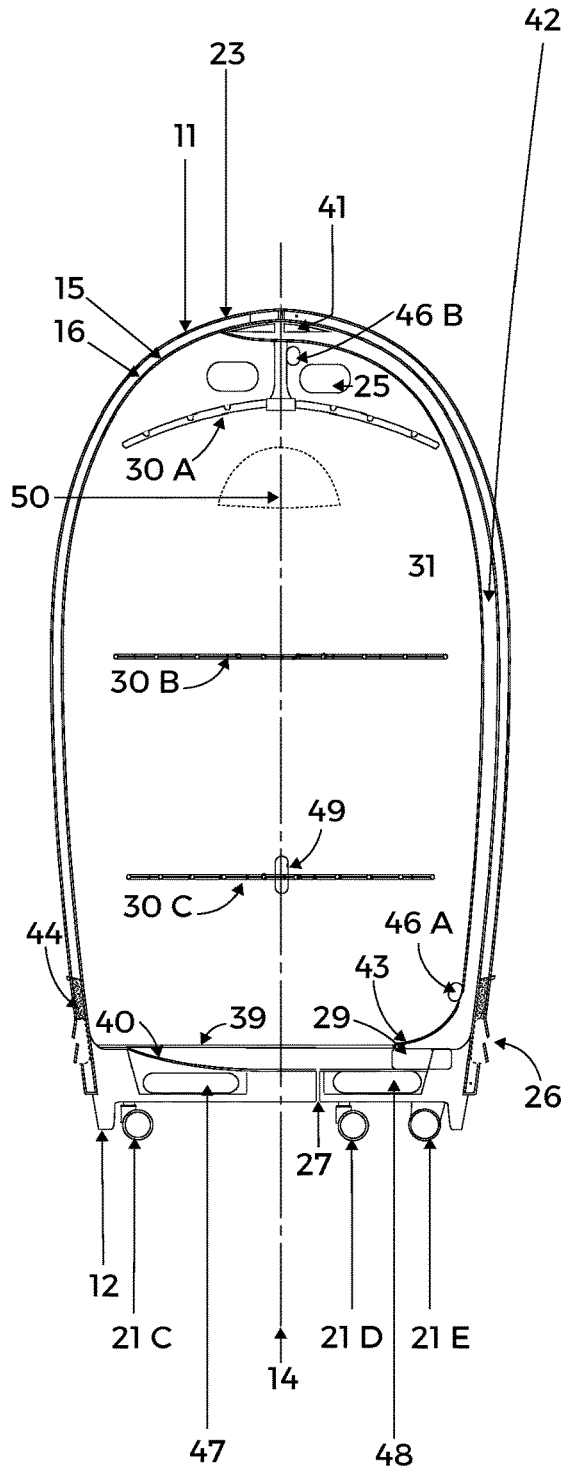
Figure 4F:
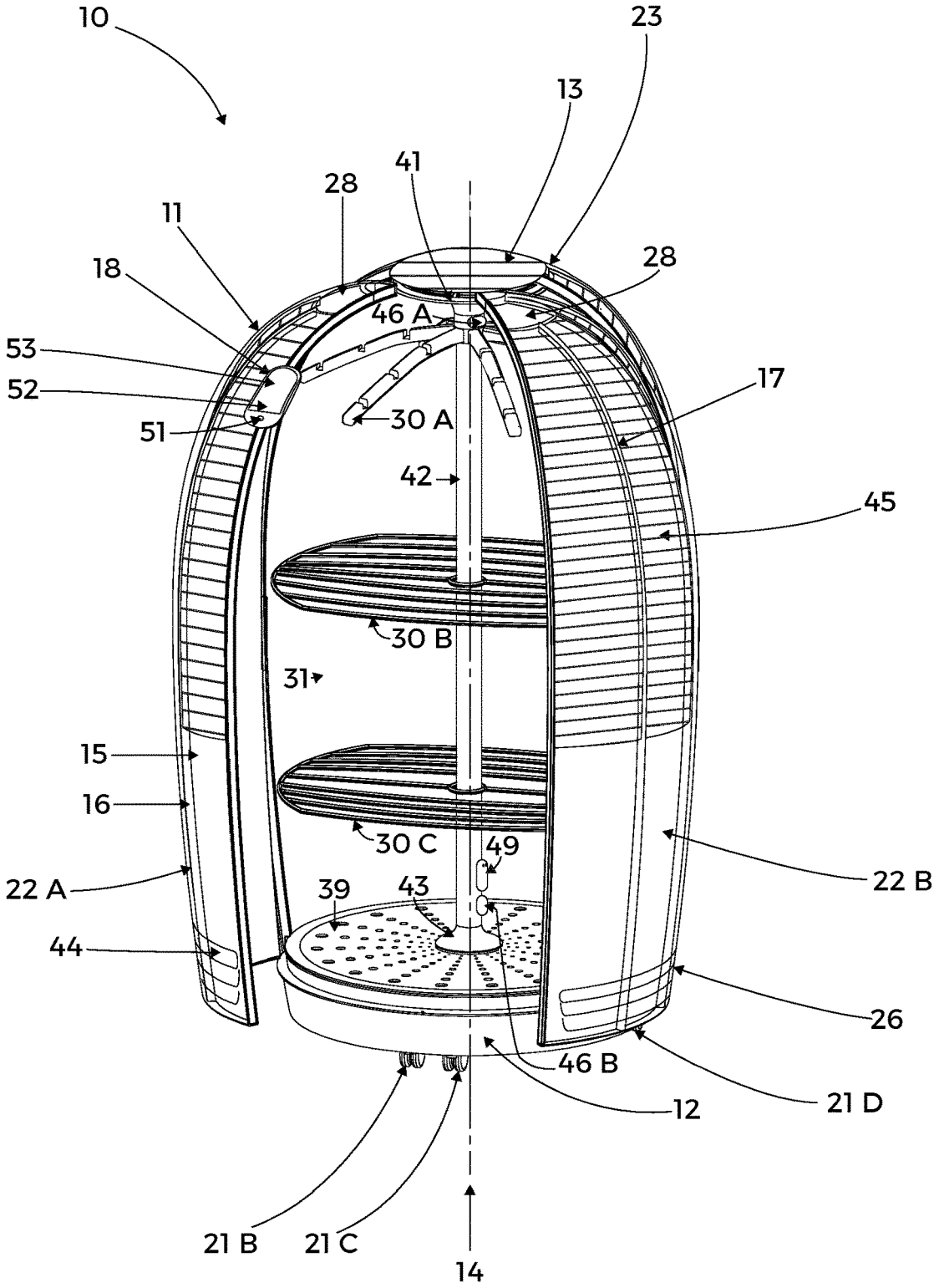
Figure 4G:
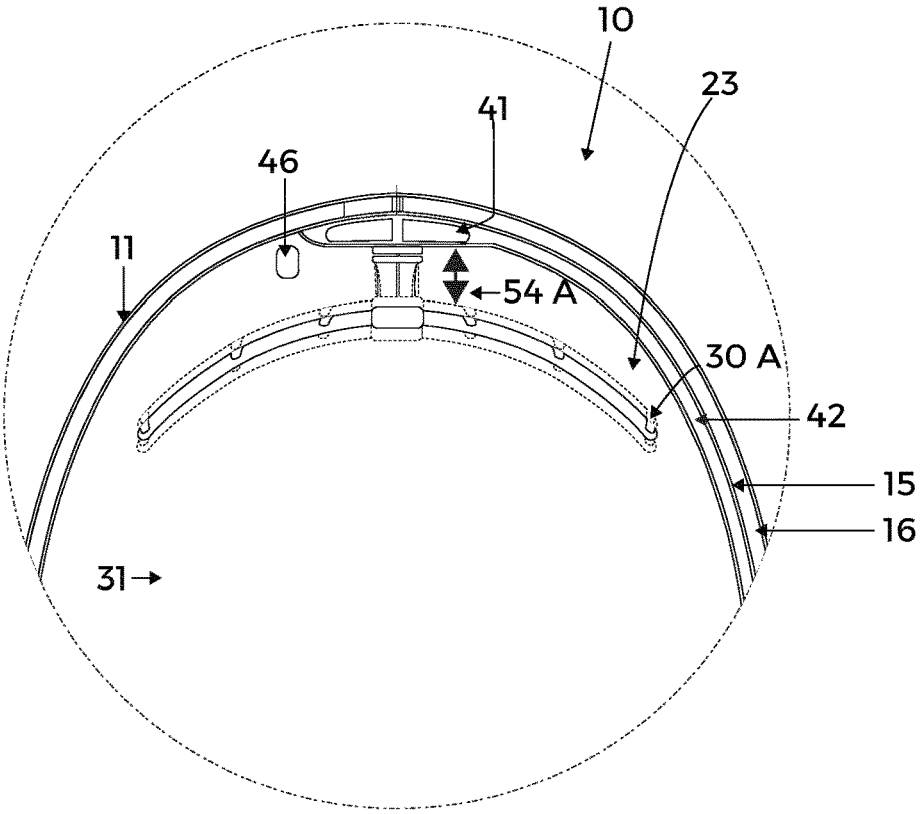
Figure 4H:
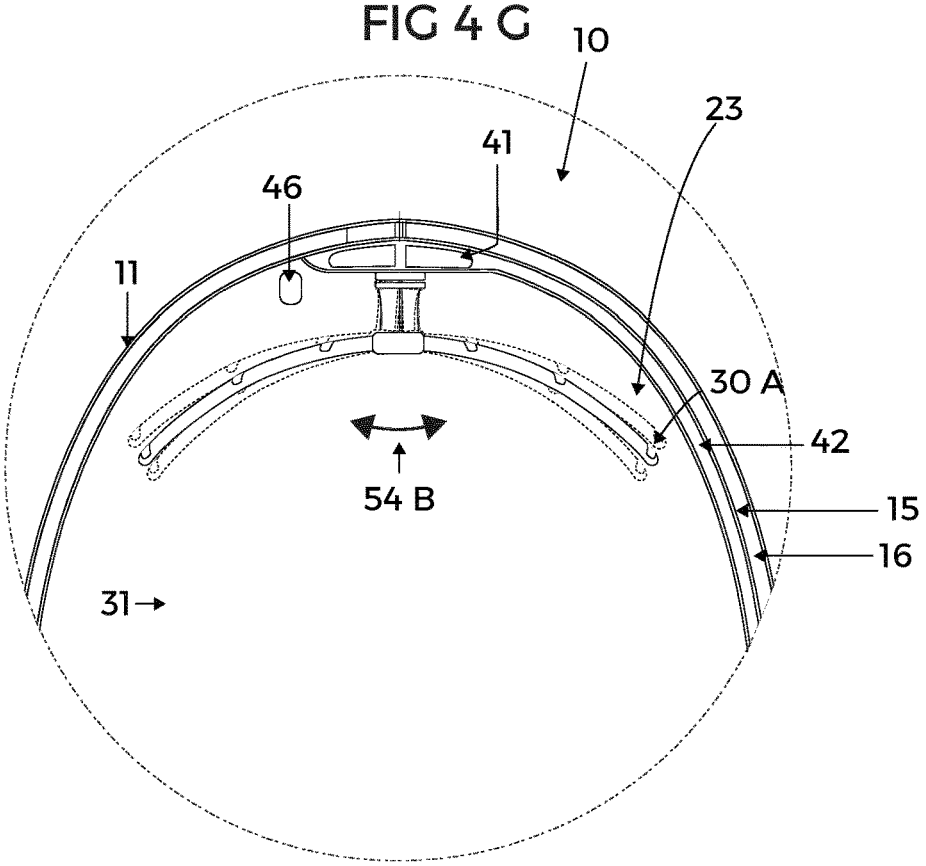
Figure 5:
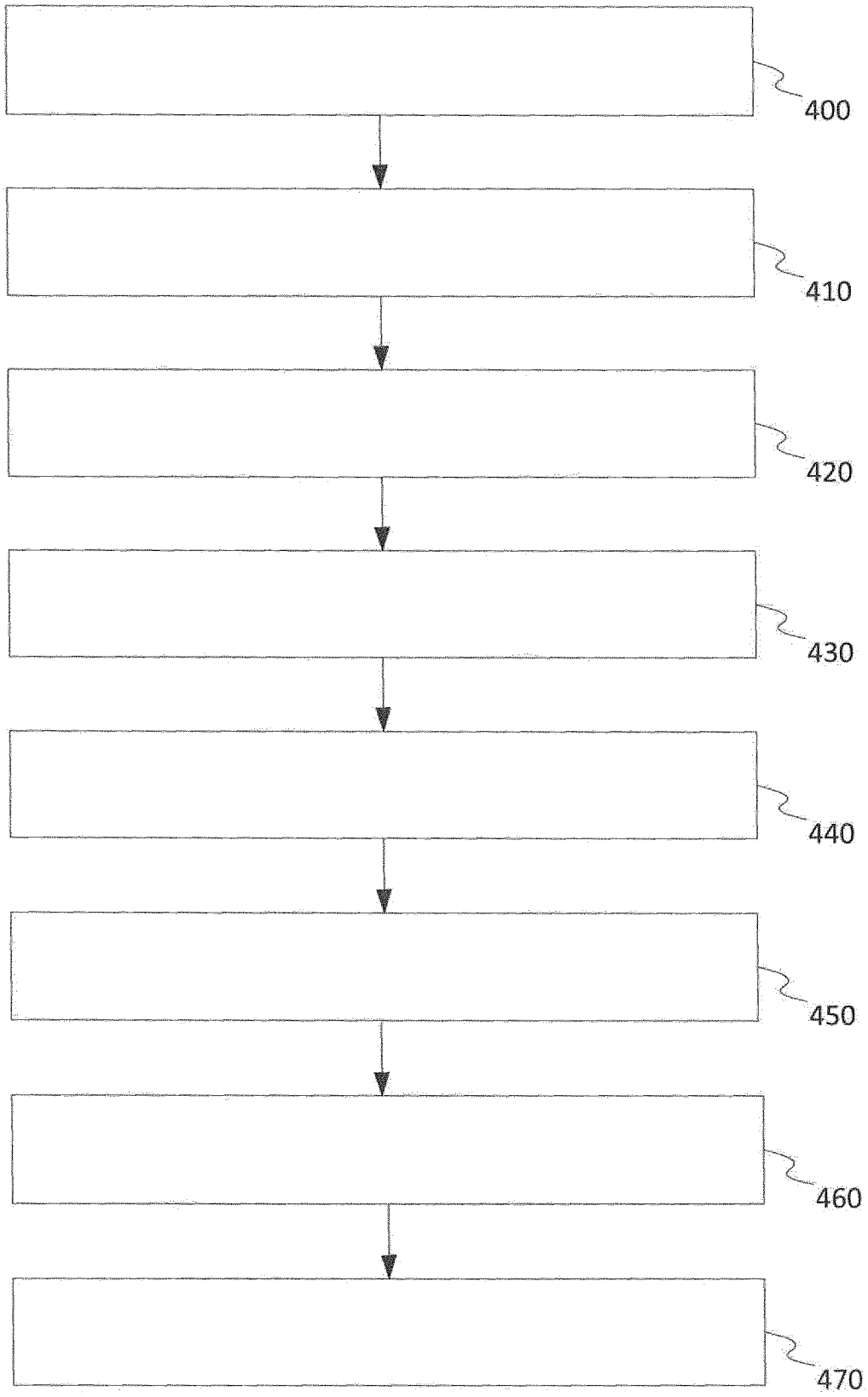

Embodiments of the present invention will now be described, by way of example only, with reference to the following diagrams wherein:

FIG. 1 parts A to G, comprise schematic illustrations of a clothes dryer (device), according to an embodiment of the present invention, in a closed configuration and in various orientations;

FIG. 2 is a schematic illustration of a preferred air flow through a clothes dryer of FIG. 1, parts A to G, according to an embodiment of the present invention, said cross-section comprising a longitudinal axis of the device;

FIG. 3 parts A and B, is an illustration of the clothes dryer of FIG. 1, parts A to G, comprising a drying rack, according to an embodiment of the present invention, in an open configuration and an upright orientation;

FIG. 4 parts A to H comprises schematic illustrations of a clothes dryer (device), according to another embodiment of the present invention; and FIG. 5 is an illustration of steps of a method of employing the clothes dryer of FIG. 1, parts A to G.

In the accompanying diagrams, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DESCRIPTION OF EMBODIMENTS OF THE INVENTION

The embodiments of the present invention will now be further elucidated by means of the figures. Where appropriate, reference numerals are maintained as consistent between figures.

FIG. 1, parts A to G, comprises schematic illustrations of a clothes dryer (device), according to an embodiment of the present invention, in a closed configuration and in various orientations. Specifically, FIG. 1A illustrates the front and base of the device in a perspective view, FIG. 1B is a plan view comprising the base, FIG. 1C and FIG. 1D show the device from the back and a first side, respectively, while FIG. 1E is a plan view comprising a top view of the device. FIG. 1F shows the device from the front and FIG. 1G shows the device from a second side, said second side being located directly opposite to the first side of FIG. 1D. Solid lines indicate the external edges of the device while dashed lines indicate interior structures not always fully visible from the outside.

In FIG. 1, parts A to G, a clothes dryer (device) is indicated generally by 10. The clothes dryer 10 comprises an exterior surface 11, a base 12 and a top 13. (The top 13 may be comprised as part of the exterior surface 11). The exterior surface or wall 11 is arranged as formed to a shape preferably comprising a (smooth continuous) radial curvature, arranged radially symmetric around a longitudinal axis of the device 10, as indicated by line 14, the precise tightness of the radial curvature depending on the size of the device and desired overall shaping. The exterior surface 11 is further arranged to comprise a longitudinal curvature running from device base 12 to device top 13, preferably arranged with a shallower curvature proximate to the base 12 of the device and a more extreme curvature proximate to the top 13. The exact nature of the longitudinal curvature is adjustable depending on desired dimensions of the clothes dryer 10, including considerations of the angular interaction of the exterior surface 11 with incident light, particularly sunlight (to be discussed later). A consequence of the longitudinal curvature is that the radius of the device is susceptible to vary along the length of the longitudinal axis.

Although the device is shown with a preferred radial symmetry, this should not be considered as limiting and it should be noted that other implementations are possible, while incorporating features of the present invention. The axial radius (i.e. the radius arranged perpendicular to the longitudinal axis 14 of the device 10) may comprise an angular dependence. In some cases, this may manifest as a minor and major radial axis of the device leading to a more elliptical radial profile, for example.

The exterior surface or wall 11 is arranged in co-operation with an interior surface or wall 15 to form a cavity wall arrangement. The enclosed cavity 16 comprises a space filled with air. Together with the base 12 and top 13, the interior surface or wall 15, at least partially defines a drying chamber (not shown). These features and their effect will be further discussed by reference to FIG. 2.

The exterior wall 11 is preferably shaped such that the overall structure comprises a shape including, for example: a ellipsoidal shape, an elliptic shape, an elliptical shape, an oblong, an ooid, an ovaloid, an ovate, an oviform, an ovoid, an egg shape, an acorn shape. The shape of the exterior wall 11 facilitates the maximisation of solar gain from incident (sun)light and/or the minimisation of adverse environmental effect, such as wind and rain. The interior wall 15 is, optionally, so shaped, thereby optionally providing a parallel arrangement and/or a tapered arrangement between the surfaces forming the cavity 16, depending on precise implementation. In other words, the shape is preferably chosen with consideration for a primary incidence angle of sunlight on the device, when the device is positioned outdoors, optimised for the purposes of obtaining a good heat absorption at the interior wall 11. The surface area of the device 10, presented to incident solar radiation is susceptible to variation during daily operation as the solar angle of incidence changes with the passage of the sun across the sky. By means of the shaping of the device exterior 11 and interior 15 surfaces, the capture of solar radiation and consequent solar gain available for the drying operation are optimised. Careful and appropriate shaping of the exterior wall 11, the interior wall 15 and/or the cavity 16, contribute to the effective functioning of the clothes drying device and assists in the optimisation of the drying process. This will be further discussed below, particularly with reference to FIG. 2. Optionally, a significant proportion of the bottom portion of the clothes dryer (e.g. one third to one half to two thirds) is arranged to approximate a cylindrical shape. Such a feature advantageously increases any storage or drying space on the interior of the device, advantageously assists with device stability and/or advantageously streamlines heating cavity geometry.

The exterior wall 11 is further arranged in co-operation with at least one rib 17. A plurality of ribs are usually implemented, preferably spaced equidistant around a radius of the device and/or each rib running from the base 12 to the top 13. The ribs act to support the material of the interior wall 15 and the exterior surface 11 and are, preferably, positioned to facilitate maintenance of a desired spacing between the interior 15 and exterior 11 surfaces. As will be explained with reference to FIG. 2, the ribs 17 also, at least partially, define at least one pathway for airflow in the cavity 16 by means of the rib size and position. Preferably, a device comprises a plurality of ribs to facilitate a plurality of air pathways, said pathways optionally arranged to act as locations for other air (flow) control structures comprising, for example, vents, inlets, outlets, flow speed controls etc. As such, the rib 17 is only one example of possible implementations of air control structures, said structures further comprising fins, splines or protrusions, for example. Only a single rib is indicated in each of the figures comprising FIG. 1, for the purpose of clarity, but the device shown in the figures comprises a plurality of rib structures. The cavity thickness (measured along a radius of the device) is arranged in consideration of, for example, the airflow required, the overall size of the device and surface area presented for heating, the number of ribs etc. However, for the particular embodiment of the device 10 as shown in the figures, a cavity thickness of up to 25 mm is designed, with a preferred implementation comprising a cavity thickness of between 10 mm and 15 mm.

Optionally, one or more rib 17 may be provided with at least one or a plurality of holes (not shown). The holes are arranged and sized to permit a limited amount of airflow between the cavities 16 defined by the ribs 17. Such a feature advantageously permits mixing of air from neighbouring cavities, thereby facilitating a distribution of warm air to other cavities, which may not be in full sun or are in partial sun for example.

Optionally, one or more rib 17 may be permitted to extend (radially) into the interior of the device 10, rather than extending only between exterior surface and interior surface to support and act as a frame of the device. This advantageously assists the stability and rigidity of the device structure.

The clothes dryer further comprises at least one door, operated by means of a door handle 18. This door handle 18 is optionally comprised in an opening mechanism (not shown) and facilitates opening of the device to allow access to the drying chamber (not shown). Opening of the device may be achieved in many ways but a preferred option will be discussed later, with reference to FIG. 3.

Optionally, the clothes dryer 10 is provided with a carrying handle 19, preferably located at the back of the device and opposite to the door handle 18, and/or arranged in cooperation with at least one wheel (see later) located in the base 12.

The top 13 is preferably arranged as an integral piece and arranged capable of supporting the weight of a fan (not shown), which is optionally provided. In the embodiment of the present invention shown in FIG. 1, the top 13 is shaped as a dome with circular base circumference.

The base 12 allows the exterior wall 11 and drying chamber to be lifted off the ground, thereby providing a clearance height 17 for the device, as illustrated in FIG. 1C and FIG. 1D. Optionally, the base 12 is provided with an additional weight to provide further stability to the device 10. This can be particularly important to give stability to the unit for withstanding e.g. wind impact or other forces, when the unit is placed in an outside environment. Optionally, the base comprises ballast weight, which is implemented in a defined area to be filled with e.g. water, sand, or other heavy material. As an additional option, the material of the ballast is chosen for its thermal properties as well as its weight: thus the ballast can be arranged to act as a heat sink, capable to release heat utilised to heat air present in or being channelled through the drying chamber. This assists heat efficiency for the clothes dryer device.

The base 12 is optionally provided with at least one wheel 21A 21B 21C 21D 21E to assist with moving the device from one location to another or, more preferably, at least three wheels for stability in situ and ease of movement during relocation of the device. The at least one wheel 21E is optimally arranged in cooperation with the carrying handle 19 such that force exerted at the carrying handle 19 is effectively translated to the at least one wheel. The breadth of any wheel may range from narrow to broad, depending on the expected load on the wheel and the required manoeuvrability of the device, a narrow wheel facilitating a smaller turning circle. A broader wheel, located at a position on the base 12 proximate to a side of the device 10 comprising the carrying handle 19 is particularly advantageous for control of the weight of the device while in movement. In a further preferred embodiment of the invention, and as shown in FIG. 1, at least four narrow wheels 21A 21B 21C 21D and one broad wheel 21E are provided, at least one wheel 21E being arranged in cooperation with the carrying handle 19 of the clothes dryer 10. The provision of two of said narrow wheels 21A 21B 21C 21D per door 22A 22B respectively, for the pair of doors illustrated, facilitates the complete removal of each door away from the main body of the clothes dryer. (As shown in the figure, the doors 22A 22B are preferably arranged to form one radial half of the device, while a back section 23 completes the other half). This will be discussed further by reference to FIG. 3. The breadth of the broad wheel 21E promotes stability and ease of movement should a user choose to tilt the device backwards, with the doors uppermost, in order to relocate the device. In said case, the full weight of the device would be supported on the broader wheel, the breadth allowing the load and pressure to be more evenly spread over a wider ground area, thereby counteracting any tendency for the device to sink and become embedded into the ground.

The interior surface 15 is optionally provided with at least one vent 24 25 for the purposes of air circulation and exhaust. FIG. 1A, in particular, clearly illustrates a preferred implementation of vents in the form of pairs of upper 24 and lower 25 vents, arranged in four pairs, spaced radially equidistant around the circumference of the interior surface 15 and, in the illustrated embodiment of the present invention positioned proximate to the base 12. Vents 24A 24B are primarily intended to facilitate the (re-)circulation of air in the drying chamber, while lower vents 25A 25B are located such as to encourage the exhaust of air, especially damp air and moisture from the chamber. Positioning of lower vents 25 proximate to the base 12 is, thus, particularly advantageous for optimal functioning of the device 10. It will be appreciated that the inlets can be positioned proximal to the base 12 and outlet vents can be positioned near the top of the device 10.

A number of (heated) air inlet structures are located to the top of the solar heating cavity, between the air control structures, to allow the transmission of the solar heated air into the interior clothes drying area. A number of interior air outlet structures and additional air inlet structures are located on the apparatus to allow for the entry/exit of both heated air & ambient exterior air to/from the interior clothes drying area. These structures also, preferably, include a mesh screen to prevent the intrusion of contaminants.

The base 12 is arranged with respect to the interior surface 15 such that the radial edge of the base 12 forms an attachment point for the interior surface 15. The ribs 17 extend at least through the cavity 16 to the exterior surface 11. This creates channels running in a direction approximately parallel to the longitudinal axis 14, from the base 12. The cavity 16 spacing and optional extension of the material of the exterior surface 11 facilitates the creation of at least one external air inlet structure 26. An example of an external air inlet structure is shown most clearly in FIG. 1A and FIG. 1B. At least one external air inlet structure 26 is present in a clothes dryer device 10. A plurality of said structures 26 is preferred, the exact number comprised in any device being determined by the number of ribs 17 comprised in the device and/or the allowance of openings at radial locations proximate to the base 12. The structure is described as an air inlet structure for the purposes of describing its primary function with respect to the air flow of the device. Similarly a water outlet structure 27 is mainly present to allow water to be removed from the device. Both the exterior air inlet structure 26 and water outlet structure 27 may also permit air to exit from the device, for example due to temperature difference effects or due to collected moisture which renders the air heavier than atmospheric or dry air.

A number of exterior air inlet structures 26 are, thus, incorporated into the exterior layer, allowing the entry of ambient air into the solar heating cavity (wall), and are preferably located to the bottom of the unit between the interior air flow control structures. Air inlet structures, preferably, include a mesh screen to prevent the intrusion of contaminants. In a preferred embodiment of the present invention, the channels created between the ribs 17 are (either singly or in pairs) alternately provided with either an external air inlet structure 26 or an upper and/or a lower vent or vent pair 24 25. Such considerations result in an even spacing of the inlets and outlets associated with the air flow within the device.

The base 12 further comprises a water outlet structure 27 for evacuation of water, condensation and/or moisture from the device 10, particularly from the drying chamber. The water outlet structure 27 is thus arranged in co-operation with the other features of the base 12 to ensure a clear passage for any fluid. The clearance height 20 facilitates easy outlet of the water from the water outlet structure 27.

Proximate to and in co-operation with, the top 13, the ribs 17, external surface 11 and internal surface 15 enclose at least one internal air inlet 28, which facilitate the transfer of air into the drying chamber.

Preferably, any inlet, vent or outlet 24 25 26 27 28 is provided with a mesh screen to prevent access of insects or other contaminants into the dryer sections, particularly the drying chamber. Optionally, any vent or outlet 24 25 26 27 28 is arranged as adjustable and/or manually operable. This facilitates a control of the airflow within the device, particularly useful for the tailoring of the correct airflow from the exterior into the device.

In summary, a specific embodiment of the present invention, as shown in FIG.1 parts A to G, relates to an elliptical shaped, free standing, mobile apparatus for the drying of clothes, in an exterior environment, utilising solar energy within a heating cavity. The device comprises a single, free standing, unit which is a combination of an elliptical outer layer of transparent (or semi-transparent) material which allows the transmission of solar energy and an elliptical inner layer of solar energy absorbing material which forms a space between itself and the outer layer, between which heated air is generated from solar energy, which is subsequently directed into the interior clothes drying area. Direction is achieved using incorporated air flow control structures, situated between the inner and outer layers, which at least partially define the path of the air flow in the cavity, while providing structural support of the apparatus itself. The clothes dryer 10 is designed to work on the principle of conduction and convection, providing a low technology approach of creating air movement through temperature differential within the unit. The device is conceived as a solar orb.

The elliptical form of the unit is designed to maximise solar gain through the maximisation of incident solar radiation under all time, location and environmental variations in daily solar output. The elliptical form also acts to reduce the impact of adverse weather condition on the apparatus, such as collection of rain, fouling with leaves or unwanted movement due to strong winds, while also improving overall exterior visual aesthetics. The elliptical shape can also be modified, by incorporating a more cylindrically shaped bottom section to increase interior storage space, overall stability and heating cavity geometry.

Incorporated between the inner & outer layers are air control structures comprising the form of fins, ribs, splines or protrusions, which act as structural supports for the main body of the unit by connecting the inner and outer shells. These air control structures create individual air heating cavities in which pockets of air are heated by solar radiation, rise in the cavity and are directed into the interior clothes drying area. These structures increase the surface area presented to incident solar radiation increasing solar gain through the absorption of more solar energy, thus transferring more heat into the cavity, maximising solar gain as the solar angle of incidence varies during daily operation. These air control structures optionally contain holes (not shown) to allow efficient mixing of air between cavities which contain/do not contain exterior air inlet structures. These air control cavities optionally taper towards the top of the unit, helping improve airflow into and within the interior clothes drying area, through acceleration of the rising heated air. An additional effect and advantage of cavity 16 being filled with air, is the provision of a temperature-insulating layer with respect to the drying chamber. The air in the cavity acts as an insulator, thereby helping to maintain the warmth of the air inside the drying chamber and the drying chamber contents.

An integrated maintenance cavity (not shown) is, optionally, included in the space between the inner and outer layer, which facilitates the routing of any wiring needed by optional integrated electrical systems. The air inlet and outlet structures, both exterior and interior, to the unit are, optionally, equipped with integrated mesh screens to help reduce contaminant access into the clothes storage/drying area. Optionally, manually operated vents are also included which aid in tailoring the correct exterior airflow into the system.

The inner layer of the apparatus, i.e. the interior surface or wall 15, is (preferably) constructed from a non-transparent high absorptivity polymer material (to absorb solar energy, for example), comprising materials such as polypropylene, polyethylene or polyvinyl chloride. Said material preferably exhibits high emissivity and low reflectivity and/or is implemented in the colour black, which effectively absorbs solar energy. The interior surface or wall 15 is also preferably arranged such that the heat energy absorbed is also available to heat the interior drying cavity directly, as well as being available to heat the air in the cavity 16. Preferably, the interior surface or wall 15 is arranged to maintain the interior drying cavity in shade or darkness, to prevent bleaching or other light damage to any clothes or materials present.

The outer layer of the apparatus, i.e. the exterior surface or wall 11, is preferably constructed from a low absorptivity transparent polymer material, which exhibits low emissivity and low reflectivity, such as polymethlamethacrylate, cellulose acetate butyrate, polycarbonate or PETG, which allows the transmission of solar energy into the heating cavity (of the cavity wall) 16. This transparent outer layer 11 is preferably UV resistant, to effect a reduction in any occurrence of UV (ultraviolet) induced degradation. Preferably, the exterior surface or wall 11 is waterproof.

(While the device 10 is primarily intended for use outdoors and maximum utilisation of solar energy, embodiments of the present invention are also susceptible to implementation for indoor use. Preferably, for such indoor use, the materials of the exterior and/or interior surfaces 11 15 are optimised for the type of lighting normally present indoors, for example by means of special films or use of daylight cells).

In addition, the apparatus preferably comprises integrated wheels 21A 21B 21C 21D 21E (allowing free movement of the device), an integrated handle system (to work in conjunction with the wheels) and an integrated based standing system (ensuring a stable orientation when in use) which also raises the base of the unit up off the ground, thereby improving airflow around the base of the unit. A centrally located water draining port, i.e. water outlet structure 27, is preferably included in the base of the unit to aid in the expulsion of waste water from the unit.

Optionally, the device 10 is further arranged to comprise additional features:

- A weight can be included, preferably in the base 12 of the device, to help improve the stability of the unit and further reduce the influence of adverse weather conditions. The design may also be arranged to provide for a ground camber. Tethering may also be applied. Said weight or camber compensation is optionally arranged as located in the base 12 of the device, which can be filled with water thus adding weight to the base of the unit, increasing overall stability. A ballast (structure), optionally comprising a heat sink material may also be added for weight and/or temperature efficiency.
- The efficiency and performance of the apparatus is, optionally, further improved by the provision of an integrated, driven, air system comprising a fan assembly. Said fan or fan assembly is optionally located in the base or top of the unit, to drive and/or improve airflow, circulation and heat profile within the unit. Such an integrated driven air system is preferably arranged to work in conjunction with the air control structures provided, to improve the airflow into the structure and within the interior clothes storage area, thereby improving the drying performance of the unit.
- The driven air system is optionally powered by an integrated solar panel, located on an exterior surface of the apparatus, which is arranged to generate either instantaneous use or battery stored power. The integrated solar panel is preferably arranged located and orientated to optimise solar energy gain through the maximisation of sunlight capture. Power, thus generated, can be stored in an integrated energy storage device, such as a battery contained in the apparatus, which stores power generated by any integrated or exterior power generation device for use by any integrated or attached electrically powered device. Performance can be improved further with the further addition of an integrated heating element into the device, improving the heating of the internal air.
- A cavity is optionally incorporated, in which to place scented materials (oils etc.) into the unit improving the smell of the drying clothes.
- A humidity control system is optionally provided, arranged to control the humidity in the device and/or operate vents to control the interior humidity. A control fan can be incorporated where the speed of the fan is controlled or an optimised drying process. The enables control of the amount of time the air has to heat, circulate and be evacuated.
- A solar powered lighting system is optionally provided in the internal cavity, to provide internal lighting, either for ease of use or for visual asthetics.
- An exterior lighting system is optionally provided, to increase external visual aesthetics.
- Internal or external patterning is optionally provided on the exterior transparent layer, to increase visual aesthetics. Preferably, the overall effect is of a dark, matte finish.
- Patterning, on exterior or interior surfaces, is optionally provided, said pattern chosen so as to increase solar gain through manipulation of the light path or said patterning being arranged to comprise nano patterning, which returns reflected solar radiation back into the heating cavity.
- A temperature control means or device such as a thermostate, is optionally arranged to monitor and/or control the interior temperature of the device and thereby stabilise the drying process. Advantageously, such a consideration is particularly suitable for implementation in the drying of sensitive or delicate materials.

A smart valve is optionally located at one or more inlets or vents, said smart valve optionally comprising a material which is sensitive to e.g. humidity (or another parameter, such as temperature) and which opens and closes in response to said parameter thereby allowing more or less air to flow through the valve.

An auto-switch-on device, optionally arranged in co-operation with a darkness sensor, is optionally arranged to make maximum use of solar energy when available.

The base 12 may be arranged to rotate, either continuously, peridically, manually or in a pre-determined way. Advantageously, this facilitates even drying of the items to be dried.

Advantageously, the device is suceptible to manufacture in a range of sizes from small scale balcony based units, to large scale exterior units.

In preferred embodiments of the present invention, as shown in the various figures, the device 10 comprises dimensions as described below. These dimensions are indicated by way of example only and should not be considered as limiting.

The illustrated device 10 is preferably designed to meet the needs of family units of one to three persons and provides approximately 5 linear metres of hanging space and/or, optionally, 0.3 square metres of drawer space for clothes drying. This is calculated as follows: each average rail accommodates 0.50 linear metres of hanging space, with 10 rails being provided (10×500 mm rails, mm being millimetres). Optionally, the rails are arranged in clusters so as to form at least one horizontal platform within the device on which items can be arranged to lie flat for drying.

The unit dimensions are preferably around 750 mm (width) by 750 mm (depth), i.e. a radius of 375 mm for radially symmetric embodiments of the present invention, by 1100 mm (height), the height being determined in consideration of a typical railing height of an apartment balcony. Said consideration minimises the undesired visual (and therefore environmental) impact of a traditional drying apparatus, such as is the case with traditional clothes lines. Many apartment developments have restricted covenants not permitting the drying of clothes on balconies due to the visual impact, this resolves this problem. Space is also frequently an issue. The width of the device is arranged to allow for ease of access through e.g. standard doors, lifts and garden gates. The main disadvantage of drying clothes outside being the unpredictability of weather, the device 10 allows clothes to dry naturally, externally, whilst protecting them from the elements.

A further preferred embodiment of the present invention comprises a taller version of the device (not shown). This particular embodiment is designed to meet the needs of larger family units and is preferably dimensioned (approximately) as 750 mm (width) by 750 mm (depth) by 1700 mm (height). Said height of 1700 mm is lower than a standard door and the dimensions allow for ease of access through e.g. doors of homes and garden gates.

By virtue of the taller dimension, this particular embodiment accommodates approximately 7.5 linear metres of hanging space, and/or optionally 0.3 square metres of drawer space for clothes drying. Each rail is arranged to accommodate 0.5 linear metres of hanging space and 15 rails are preferably provided (15×500 mm rails). Optionally, the rails are arranged in clusters so as to form at least one horizontal platform within the device on which items can be arranged to lie flat for drying.

Referring now to FIG. 2, which is a schematic illustration of a preferred air flow through a clothes dryer of FIG. 1, parts A to G, according to an embodiment of the present invention, said cross-section comprising a longitudinal axis of the device, features of the device are referred to by means of reference numerals consistent with FIG. 1, parts A to G. Additional features illustrated in FIG. 2 comprise a fan 29, drying rack 30, and a (clothes) drying chamber 31, the drying rack 30 being illustrated as comprising two parts 30A 30B.

The clothes dryer 10 of FIG. 2 relates to an elliptical shaped, free standing, mobile solar clothes dryer which utilises its elliptical form to maximise solar energy gain. In the figure, solar energy gain is schematically illustrated by a group of arrows 32.

Sunlight is incident on the device 10, is transmitted (at least partially) through the exterior surface 11, contacts the air as it passes through the cavity 16 to reach the interior surface 15, where it is preferably absorbed and converted to heat. The heat from the interior surface 15 then further warms the air present in the cavity 16. Said energy used to heat air contained in the cavity 16, then renders the air subject to motion, due to induced temperature and pressure differentials over the cavity wall arrangement of the device. Generally speaking, the warmer the air becomes, the greater the tendency to rise. A suitable arrangement of a shape of the air path, for example by means of the shaping of the cavity 16, can add to a pressure differential effect and a heating effect of the air, which in turn can assist the movement of air through the device 10. The heated air is subsequently being directed into an interior clothes drying area 31 using a combination of integrated inlet structures and integrated air flow control structures.

Optionally, the drying chamber 31 can be arranged to comprise an additional heater, for example an electrical heater powered by a battery, which in turn is optionally changed using a separate solar cell located in sunlight on an exterior surface of the device 10. Use of said heater acts to accelerate a drying process within the drying chamber 31.

In preferred embodiment of the present invention, the exterior surface or wall 11 is arranged to comprise a transparent material which allows the transmission of solar energy or light energy to heat air held in the cavity 16 and/or the interior surface 15, the interior surface 15 being preferably arranged as comprising a material capable of absorbing such energy. The resulting energy absorption facilitates heating of the air in the cavity 16, which is guided to the drying chamber by air movement initiated by temperature difference, pressure difference and cavity design. Optionally, a fan 29, preferably comprised in co-operation with the top 13 of the device 10, can be used to increase the speed and/or flow of the heated air and/or propel it into the drying chamber with greater penetration of the depth of the drying chamber. Said fan can be operated continuously, arranged to run in a pulsed or other discontinuous manner or made subject to manual switching on and/or off, depending on choice according to various embodiments of the present invention.

A mounted solar panel and/or battery (not shown) can be, optionally, arranged to provide electrical power to the fan 29. Said mounted solar panel or battery can be used to provide instantaneous power or, by suitable implementation, the power can be stored for future use by the device. Optionally, the device is arranged to comprise an integrated wire storage area (not shown) or wire conduits (not shown), arranged to facilitate the placement of any electrical wiring. An integrated maintenance cavity (not shown) is optionally provided.

In FIG. 2, arrows are used to illustrate a preferred airflow through the clothes dryer 10. Clothes to be dried are not illustrated but the drying racks 30A 30B are shown. This preferred airflow is one of many possible implementations according to embodiments of the present invention.

In FIG. 2 the airflow is shown as being transmitted through the drying chamber 31 from top to bottom, the central channel being a main conduit for incoming air, which is then routed towards the sides before passing upwards again. The solar gain effect 32 triggers a heating of air in the cavity 16 causing air movement towards the top 13 of the device 10. This is shown by arrows 33A 33B 33C 33D. Said movement causes air to flow into the clothes dryer 10 by means of at least one exterior air inlet structure 26 (a plurality of which are shown comprised in the device of FIG. 2). This is indicated by arrows 34A 34B. The fan 29 accelerates the heated air downwards from the top 13 towards the base 12, indicated by arrow group 35. The chosen arrangement of the drying rack into two halves 30A 30B facilitates further movement of the air by allowing a clear, clothes free, central corridor for the accelerated air, which progresses towards the base as indicated by arrows 36A 36B. As the air moves, some of the air spreads outwards towards the sides of the drying chamber 31, as indicated by arrows 37A 37B 37C 37D 37E 37F. The warm air contacts clothes placed on the rack 30 and facilitates the required drying process for the clothes. Moisture picked up by the air following contact with damp clothes tends to be heavy and expelled through one of the vents. Upper vents 24 and lower vents 25 A 25B co-operate to facilitate air re-circulation with the drying chamber 31 and incorporate fresh air intake and air and moisture expulsion, as explained previously.

In a preferred embodiment of the present invention, 50% of the air corridors (or cavities or cavity wall strips running longitudinally from base to top, formed e.g. by means of the ribs) 16, comprised in the shell of the device, are arranged to draw in (via inlets 26) and heat external fresh air. A further 50% of said air corridors are arranged to recirculate and reheat internal air. The fan is arranged to assist the pulling of air through said air corridors to the top before accelerating the heated air into the chamber 31. While the lower section of the device 10 is arranged to optimise the exit of air and moisture from the device.

The fan 29 can be implemented as a single device or as a plurality of individual fans arranged co-operatively. The fan 29 can be implemented as a single fan present in the device, or a fan assembly located at a preferred position in the device, or may be one of a plurality of fans located at various positions in the device. The fan 29 advantageously increases air circulation within the unit or assists in developing a desired direction or speed or intensity of air flow. A preferred multi-fan implementation of embodiments of the present invention comprises a fan located in co-operation with the top 13 of the device, arranged to drive air downwards and a fan located proximate to the base 12, arranged to accelerate the expulsion of moist air from the device 10.

Referring now to FIG. 3, parts A and B, which is an illustration of the clothes dryer of FIG. 1, parts A to G, comprising a drying rack 30, according to an embodiment of the present invention, in an open configuration and an upright orientation. Reference numerals are consistent with those used to identify features comprised in FIG. 1, parts A to G, where appropriate. FIG. 3, parts A and B, illustrates a specific embodiment of the present invention, wherein the clothes rack, i.e. the drying rack 30, comprises two parts, here specifically two halves 30A 30B, each of which is independently removable from the interior (clothes) drying chamber 31. The clothes drying chamber 31 can also be used for storage of clothes or other times, particularly when the device 10 is not in active use.

The (clothes) dryer device 10 preferably comprises a forward opening door mechanism, comprising two parts, allowing easy access into the internal clothes drying area. This door mechanism preferably comprises a single forward opening single hinged door, two forward opening centre split doors which are each individually hinged to each side of the unit, a single upward lifting door mechanism or, as illustrated, a two piece split wheeled door mechanism 22A 22B, incorporating at least one integrated clothes storage mechanisms, comprising for example, drying racks 30A 30B. The latter embodiment of the present invention is shown in FIG. 3, parts A and B.

As illustrated in the figures, the doors 22A 22B comprise air control structures in the form of ribs, inlets and vents. Optionally, such structures can be comprised only in a main body section of the device 10. In such a case, it is preferable that the positioning of the device is advantageously arranged so that the main body section can capture solar energy i.e. is placed in full sun.

Preferably, door mechanisms comprise incorporated door sealing systems (not shown), which seal the door unit when clothes are to be dried—thus, advantageously, allowing the solar heating operation to operate in the door air cavities in conjunction with the cavities in the main body of the unit.

The apparatus or device 10 comprises a (clothes) drying rack 31, preferably anchored by the interior layer of material, which optionally comprises a number of wire hanging rails on which to store/hang the clothes or material or items to be dried, or already dried. This clothes rack 31 can be optionally incorporated into the structure itself, or into the door mechanism, and can be arranged to slide out of the main body of the device, and thus also the drying chamber 31, to allow easier access to the clothing/material and rack. Optionally, the drying rack 31 is provided with wheels (not shown).

Air Pathway Channel Embodiment

Referring to FIG. 4 parts A to H comprises schematic illustrations of a clothes dryer (device), according to another embodiment of the present invention. The clothes dryer shown in FIG. 4, parts A to H, is similar to the clothes dryer of FIGS. 1 and 2 described above. Overlapping and common reference numerals are used for ease of reference. The device 10 comprises at least one inlet 26 positioned near the base along with at least one air filter 44 to prevent dirt, insects and the like entering the drying chamber. One or more solar panels/cells 45 can be strategically positioned on the outer surface of the device 10 to maximise solar collection. A locking mechanism 51 can be provided to open and securely close the clothes dryer. This can be a mechanical or electrically operated. A digital display 51 and interface 52 can be used to turn the clothes dryer on/off. The digital display 51 can display drying times, solar blockages, for example dirt on the unit, temperatures, and optimised position suggestions. This can also interact with an 'app' loaded onto a user electronic device for user information and drying cycles.

Referring to FIG. 4B there is illustrated a transparent viewing window 50 for viewing clothes in the drying chamber. An inlet 24 is configured to receive air and an outlet 25 for exhausting air after drying is shown. FIG. 4C shows a cut-through view of FIGS. 4A and 4B where air enters inlet 26 near the base of the device and is urged upwards along channel in the direction of 33A, 33B, 33C and 33D to the top of the device where the air is heated. A funnel 41 directs the heated air from the cavity into a trunk/air distribution channel 42. It is a curved surface to minimise turbulence due to the air direction change. The trunk/air distribution channel 42 takes heated, dry air from the funnel 42 and conveys it to the bottom of the drying chamber. The heated air can be urged down (either pulled or pushed down) to the bottom of the drying chamber via the trunk/air distribution channel 42 in the arrow direction 36 by the fan 29, for example a centrifugal fan, which can be positioned at the base or near the top of the drying chamber. This allows for even heat distribution throughout the drying chamber, as the hot air and humid air rises from the base, and also provides an improved air-path for drying as shown by arrows 37.

To improve the hot air distribution a distribution plate 39 and perforated plate 38 can be located near the base and in communication with one end of the trunk/air distribution channel 42. The fan 29 draws the hot air from the funnel down the trunk/air distribution channel 42. From here the distribution plate 39 and perforated plate 38 work in conjunction to distribute the air as desired, where the air distribution is shown by arrows 37. A battery 47, that can be recharged by the solar cell and a Printed circuit board (PCB) 48 can be positioned in the base to provide additional functionality.

A shown in FIGS. 4D and 4E the trunk/air distribution channel 42 can be located in various positions in the drying chamber. FIG. 4D shows the channel 42 positioned substantially through the center of the drying chamber, whereas FIG. 4E shows the channel positioned proximal to a sidewall of the drying chamber. The channel 42 can be positioned at any location so as to facilitate heated air to be conveyed to substantially near the base.

FIG. 4F shows a 3D perspective view of the clothes dryer of FIGS. A to D. As can be seen the perforated plate 39 can comprise of a number of perforations or openings. The size of the perforations can be dimensioned to enable even distribution of hot air in the drying chamber during drying operation. The distribution plate 38 can be curved to distribute the air at an even pressure based on the fan location. A plurality of sensors 46A & 46B can be positioned in the chamber to measure or monitor various parameters, such as temperature and humidity. The fan 29 can be covered by a protective casing 43. A scent diffuser 49 can be located in the drying chamber to scent clothes as they are dried. The scent diffuser 49 can be refilled with a desired scent as required.

FIG. 4H shows an embodiment how the drying rack 30A,B and C can be attached to the drying chamber with a hanging mechanism mount that allows both lateral 54B and vertical movement 54A of the drying rack 30A, B and C. The hanging mechanism mount can be a soft mounted or spring mounted hanging mechanism that allows for movement of the entire hanging mechanism. This encourages movement within the chamber, agitating clothes, which encourages evaporation.

Referring to FIG. 5, which is an illustration of steps of a method of employing the clothes dryer of FIG. 1 parts A to G and FIG. 4 parts A to H, the clothes dryer 10 functions in a manner as defined by steps of a method whose steps are illustrated. The method comprises provision of air control structures and device features, which facilitate the manipulation of light energy for the heating of air in a cavity wall arrangement, for input into a drying chamber to facilitate clothes drying, as explained above.

A first step 400, comprises 'defining a drying chamber (31), arranged to accommodate clothes, by means of at least one wall'. Step 410, comprises 'defining air pathway, along which air is arranged to flow from an air inlet to an air outlet, comprising the drying chamber (31)'. Step 420, comprises 'arranging the at least one wall to comprise a cavity wall comprising a first surface (11), a cavity (16) and a second surface (15). Step 430, comprises 'arranging the first surface (11) of the cavity wall to define an exterior surface of the dryer and to facilitate a transmission of light energy to the cavity (16) and/or the second surface (15)'. Step 440, comprises 'arranging the cavity (16) to be comprised in the air pathway' and, step 450, comprises 'arranging the second surface (15) of the cavity wall to define at least a part of the drying chamber (31)'.

Although embodiments of the invention are described in the foregoing, it will be appreciated that the present invention is also susceptible to being implemented in a number of ways. Various combinations of features and implementations can be applied, according to the many embodiments of the present invention, such that a combination of optimised form of the device, air heating cavity design, air control structure implementation, integrated fan, solar panel, battery and efficient exhaust and outlet facilities, provide a user with an optimised device and method for drying clothes or other textiles, especially household items.

Modifications to embodiments of the invention described in the foregoing are possible without departing from the scope of the invention as defined by the accompanying claims. Expressions such as "including", "comprising", "incorporating", "consisting of", "have", "is" used to describe and claim the present invention are intended to be construed in a non-exclusive manner, namely allowing for items, components or elements not explicitly described also to be present. Reference to the singular is also to be construed to relate to the plural. Numerals included within parentheses in the accompanying claims are intended to assist understanding of the claims and should not be construed in any way to limit subject matter claimed by these claims.

In the specification the terms "comprise, comprises, comprised and comprising" or any variation thereof and the terms include, includes, included and including" or any variation thereof are considered to be totally interchangeable and they should all be afforded the widest possible interpretation and vice versa.

The invention is not limited to the embodiments hereinbefore described but may be varied in both construction and detail.

LIST OF REFERENCE NUMERALS

10 clothes dryer (device)
11 exterior surface or wall
12 base
13 top—cap with solar cell
14 longitudinal axis
15 interior surface or wall
16 cavity
17 rib
18 door handle
19 carrying handle
20 clearance height
21 A B C D E wheel
22 A B door

23 back section
24 vent—In-Air circulation
25 vent—Exhaust
26 exterior air inlet structure
27 water outlet structure
28 internal air inlet
29 fan
30 A B C drying rack (hanging mechanism)
31 (clothes) drying chamber
32 group of arrows indicating solar energy gain
33 A B C D E Farrows indicating heated air movement towards the top of the device
34 A B arrows indicating air flow into the device by means of exterior air inlet structures 26
35 group of arrows indicating air propelled away from the fan 29
36 A B arrows indicating air progressing through a corridor
37 Arrows indicating the spread of air in the drying chamber
38 Group of arrows indicating Air being expelled from device.
39 Distribution Plate
40 Curved Base Distribution Plate.
41 Air Funnel—(Contact Point at the top)
42 Trunk/DUCT/channel
43 Fan Casing
44 Filter
45 Solar Cell
46 Sensors A+B—description of types of sensors in the Patent. (Temp, Humidity etc)
47 Battery
48 PCB
49 Scent Diffuser
50 Viewing Window
51 Locking Mechanism
52 Digital Display Screen
53 User Interface
54 AB Directional Arrow showing movement of the hanging mechanism (30 ABC)
400 method step: defining a drying chamber (31), arranged to accommodate clothes, by means of at least one wall
410 method step: defining air pathway, along which air is arranged to flow from an air inlet to an air outlet, comprising the drying chamber (31)
420 method step: arranging the at least one wall to comprise a cavity wall comprising a first surface (11), a cavity (16) and a second surface (15)
430 method step: arranging the first surface (11) of the cavity wall to define an exterior surface of the dryer and to facilitate a transmission of light energy to the cavity (16) and/or the second surface (15)
440 method step: arranging the cavity (16) to be comprised in the air pathway
450 method step: arranging the second surface (15) of the cavity wall to define at least a part of the drying chamber (31)

What is claimed is:

1. A clothes dryer comprising:

a drying chamber, arranged to accommodate clothes, defined by at least one wall, an air pathway, along which air is arranged to flow from an air inlet to an air outlet, comprising the drying chamber (31), wherein the air pathway comprises a curved surface configured to minimize turbulence due to air direction change, wherein the at least one wall comprises:

a continuous radial curvature arranged radially symmetric around a longitudinal axis of the clothes dryer, a longitudinal curvature running from a base of the clothes dryer to a top of the clothes dryer, with a shallower curvature proximate to the base of the clothes dryer and a more extreme curvature proximate to the top of the clothes dryer, such that the longitudinal curvature allows a radius of the clothes dryer to vary along a length of the longitudinal axis of the clothes dryer, the at least one wall further comprises a cavity wall comprising a first curved surface, a cavity and a second curved surface, the first curved surface of the cavity wall being arranged to define an exterior surface of the clothes dryer and to facilitate a transmission of light energy to the cavity and/or the second curved surface, the cavity being arranged in the air pathway, wherein the cavity is configured to cooperate with an air pathway channel where the air enters the air inlet positioned near the base of the clothes dryer and is urged upwards along the cavity in a direction to a top of the drying chamber where a funnel directs heated air from a top of the cavity into the air pathway channel and convey the heated air towards a bottom of the drying chamber before entering the drying chamber, and, the second curved surface of the cavity wall being arranged to define at least a part of the drying chamber, wherein said first curved surface and said second curved surface enable collection of the light energy from a range of incident light from perpendicular to tangential at all times, such that said first curved surface and said second curved surface are configured to prevent overheating, and wherein said first curved surface and said second curved surface are further configured to reduce stagnation and minimize resistance to airflow by harnessing a Venturi effect, such that said first curved surface and said second curved surface curve-in to create a restriction and increase velocity.

2. The clothes dryer as claimed in claim 1, wherein the second curved surface is configured as, at least partly, opaque and/or capable of absorption of the light energy.

3. The clothes dryer as claimed in claim 1, wherein the clothes dryer further comprises at least one rib arranged in co-operation with the first curved surface and the second curved surface to further define at least one additional cavity, a length of the at least one rib being arranged in a plane parallel to the longitudinal axis of the clothes dryer.

4. The clothes dryer as claimed in claim 3, wherein the at least one rib comprises at least one aperture located proximate to the cavity to permit a limited amount of the airflow between the at least one additional cavity defined by the at least one rib to regulate the airflow and thermal gain between the cavity and the at least one additional cavity (16) that are adjacent to one another.

5. The clothes dryer as claimed in claim 3, wherein the at least one rib is curved and dimensioned to encourage drying the air upwards from the base and provide an increased heat transfer surface area for the air to pass over.

6. The clothes dryer as claimed in claim 1, wherein the light energy transmitted to the cavity and/or the second curved surface is solar energy or energy from at least one solar cell.

7. The clothes dryer as claimed in claim 1, wherein the first curved surface and/or second curved surface of the cavity wall further comprise a wall shape in a form of one of: an ellipsoidal shape, an elliptic shape, an elliptical shape, an oblong, an ooid, an ovaloid, an ovate, an oviform, an ovoid, an egg shape, an acorn shape.

8. The clothes dryer as claimed in claim 1, wherein the cavity is tapered or shaped or dimensioned according to a shape of the first curved surface and/or the second curved surface, to control said airflow within the cavity.

9. The clothes dryer as claimed in claim 1, wherein a first material of the first curved surface is arranged to comprise an absorptive transparent polymer material, arranged to exhibit emissivity and reflectivity properties, and/or one of: polymethlamethacrylate, cellulose acetate butyrate, polycarbonate or PETG, and/or is arranged as UV resistant, and/or is waterproof, and/or is arranged to comprise a pattern or nano pattern.

10. The clothes dryer as claimed in claim 1, wherein a second material of the second curved surface is arranged to comprise a non-transparent absorptive polymer material or aluminum, and/or one of: polypropylene, polyethylene or polyvinyl chloride, and/or said second material is arranged to exhibit emissivity and reflectivity properties, and/or is implemented in a color black and/or is arranged to comprise a pattern or nano pattern, and/or is arranged to maintain the drying chamber in partial shade, shade or darkness.

11. The clothes dryer as claimed in claim 1, further comprising at least one additional exterior air inlet structure and/or at least one lower vent and/or at least one upper vent.

12. The clothes dryer as claimed in claim 11, wherein said at least one additional exterior air inlet structure and/or the at least one lower vent and/or the at least one upper vent, are arranged to cooperate with at least one rib to define at least one channel air path.

13. The clothes dryer as claimed in claim 1, wherein the clothes dryer (10) further comprises a fan.

14. The clothes dryer as claimed in claim 1, wherein the base is arranged to be rotatable, either continuously, periodically, manually or in a pre-determined way.

15. The clothes dryer as claimed in claim 14, wherein the base comprises at least one water outlet structure.

16. The clothes dryer as claimed in claim 14, wherein the base comprises a weight as a ballast structure.

17. The clothes dryer as claimed in claim 16, wherein the ballast structure is configured as a heat sink, arranged to provide a release of heat to maintain a drying temperature of the drying chamber and the air circulating or channeled into the drying chamber.

18. The clothes dryer as claimed in claim 1, wherein the air pathway channel is positioned through a center of the drying chamber.

19. The clothes dryer as claimed in claim 1, wherein the air pathway channel is positioned proximal to a sidewall of the drying chamber.

20. The clothes dryer as claimed in claim 1, wherein the funnel directs the heated air from the cavity into the air pathway channel and the funnel comprises a curved surface to minimize the turbulence due to the air direction change.

21. The clothes dryer as claimed in claim 13, wherein the fan (29) is configured to urge the heated air towards the base of the drying chamber via the air pathway channel.

22. The clothes dryer as claimed in claim 21, wherein the fan is positioned near the top of the drying chamber to push the heated air towards the base of the drying chamber.

23. The clothes dryer as claimed in claim 21, wherein the fan is positioned near the bottom of the drying chamber to pull the heated air towards the base of the drying chamber.

24. The clothes dryer as claimed in claim 1, further comprising a distribution plate and perforated plate positioned near the base and coupled with one end of the air pathway channel.

25. The clothes dryer as claimed in claim 1, further comprising a hanging mechanism that is mounted and allows both lateral and vertical movement of a drying rack.

* * * * *